US011518633B2

(12) United States Patent
Okawara

(10) Patent No.: US 11,518,633 B2
(45) Date of Patent: Dec. 6, 2022

(54) SHEET FEED DEVICE

(71) Applicant: RISO KAGAKU CORPORATION, Tokyo (JP)

(72) Inventor: Miki Okawara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 130 days.

(21) Appl. No.: 17/189,657

(22) Filed: Mar. 2, 2021

(65) Prior Publication Data

US 2021/0284471 A1 Sep. 16, 2021

(30) Foreign Application Priority Data

Mar. 11, 2020 (JP) ..... JP2020-041547
Mar. 24, 2020 (JP) ..... JP2020-052953

(51) Int. Cl.
*B65H 3/48* (2006.01)
*B65H 1/18* (2006.01)
(Continued)

(52) U.S. Cl.
CPC ..... *B65H 3/48* (2013.01); *B65H 1/04* (2013.01); *B65H 1/14* (2013.01); *B65H 1/18* (2013.01);
(Continued)

(58) Field of Classification Search
CPC ... B65H 1/08; B65H 1/14; B65H 1/18; B65H 3/128; B65H 3/46; B65H 3/48; B65H 7/14; B65H 7/16; B65H 2406/12; B65H 2511/15; B65H 2513/512; B65H 2553/40; B65H 2553/41; B65H 2553/414
See application file for complete search history.

(56) References Cited

U.S. PATENT DOCUMENTS 10,513,404 B2 12/2019 Akai et al.
2006/0012107 A1 1/2006 Ueda et al.
(Continued)

FOREIGN PATENT DOCUMENTS

CN 101910032 12/2010
CN 102085967 6/2011
(Continued)

OTHER PUBLICATIONS

Oct. 10, 2022 Chinese Office Action in the counterpart Chinese application No. 20211026539.1.

*Primary Examiner* — Prasad V Gokhale
(74) *Attorney, Agent, or Firm* — Greenblum & Bernstein, P.L.C.

(57) ABSTRACT

A controller drives a floating unit and a conveyor to perform a sheet feed operation, during the sheet feed operation, acquires an amount of received light at a detector during floating of sheets floated by the floating unit each time each sheet is conveyed by the conveyor, and perform a following control of lifting a stacking tray upon the acquired amount of received light being less than a threshold value. The controller, after start of the sheet feed operation, samples amounts of received light at the detector during floating of the sheets floated by the floating unit, performs a threshold value determination process of determining the threshold value by using the sampled amounts of received light, and starts the following control upon determining the threshold value.

11 Claims, 16 Drawing Sheets

(51) Int. Cl.

| | |
|---|---|
| ***B65H 5/22*** | (2006.01) |
| ***B65H 1/04*** | (2006.01) |
| ***B65H 3/14*** | (2006.01) |
| ***B65H 3/12*** | (2006.01) |
| ***B65H 7/14*** | (2006.01) |
| ***B65H 7/16*** | (2006.01) |
| ***B65H 1/14*** | (2006.01) |

(52) U.S. Cl.
CPC ..... *B65H 3/128* (2013.01); *B65H 3/14* (2013.01); *B65H 5/224* (2013.01); *B65H 7/14* (2013.01); *B65H 7/16* (2013.01); *B65H 2553/414* (2013.01)

(56) References Cited

U.S. PATENT DOCUMENTS

| | | | | |
|---|---|---|---|---|
| 2011/0140345 | A1* | 6/2011 | Suzuki | B65H 1/14 271/90 |
| 2015/0166280 | A1* | 6/2015 | Hino | B65H 1/14 271/11 |
| 2017/0160689 | A1* | 6/2017 | Sugawara | B65H 7/14 |
| 2019/0112137 | A1* | 4/2019 | Dahlqvist | B65H 1/14 |
| 2019/0202647 | A1* | 7/2019 | Sugawara | B65H 1/14 |

FOREIGN PATENT DOCUMENTS

| | | |
|---|---|---|
| CN | 104249941 | 12/2014 |
| CN | 107010432 | 8/2017 |
| JP | 2019-011150 | 1/2019 |
| JP | 2019-59564 | 4/2019 |

* cited by examiner

SHEET FEED DEVICE

CROSS REFERENCE TO RELATED APPLICATION

This application is based upon and claims the benefit of priority from the prior Japanese Patent Application Nos. 2020-041547 filed on Mar. 11, 2020 and 2020-052953 filed on Mar. 24, 2020, the entire contents of which are incorporated herein by reference.

BACKGROUND

1. Technical Field

The disclosure relates to a sheet feed device which feeds sheets.

2. Related Art

As a sheet feed device which feeds sheets, a sheet feed device which blows air to sheets (a sheet stack) stacked on a sheet feed tray to float sheets, conveys a top (topmost) sheet of the floated sheets while sucking the top sheet with a suction conveyance means, and supplies the top sheet to a sheet feed destination is known.

A sheet feed device described in Japanese Patent Application Publication No. 2019-11150 performs a following control of lifting a sheet feed tray in response to decrease of sheets on the sheet feed tray due to sheet feeding. In the following control of the sheet feed device, an amount of received light (sensor value) of a reflected light from a floated sheet is acquired by an optical sensor once for each feeding of sheets and the sheet feed tray is lifted upon the acquired sensor value being less than a threshold value. With the above control, the sheet feed tray is lifted in response to decrease of sheets (sheet stack) on the sheet feed tray due to sheet feeding, thereby maintaining a height position of an upper surface of sheets (sheet stack) on the sheet feed tray to a target position suitable for sheet feeding.

If the number of sheets on the sheet feed tray decreases due to sheet feeding and the height position of the sheet feed tray is not changed, the number of sheets existing within a detection range (a field of view) of the sensor decreases due to decrease in the number of sheets that can be floated by air blowing from an air blow opening and thus an acquired sensor value decreases. Accordingly, as aforementioned, the height position of the upper surface of sheets (sheet stack) on the sheet feed tray is maintained to the target position suitable for sheet feeding by lifting the sheet feed tray when the acquired sensor value becomes less than the threshold value.

The sheet feed device above changes conditions such as an amount of air blow for floating sheets depending on combinations of sheet sizes and sheet types (sheet thickness). Thus, the floating state of sheets changes depending on the combinations of the sheet sizes and the sheet types. Further, the reflection rate of sheets changes depending on sheet colors and sheet types (sheet quality). To address these issues, it is considered to set a threshold value of a sensor value used for the following control above for every combination of the sheet sizes, the sheet types, and the sheet colors, in order to meet various sheet sizes and the like.

SUMMARY

The accuracy of the following control may be decreased due to other various factors which influence the sensor values even if a threshold value is set for every combination of the sheet sizes, the sheet types, and the sheet colors. As other various factors which influence the sensor values, there are a stack position of a sheet stack (a distance between a sensor and a sheet stack), the age deterioration of a sensor, the characteristic change of a sensor due to the ambient temperature change, adherence of paper powder to a sensor, and the like.

Moreover, the accuracy of the following control may also be decreased due to the unsuitability of a threshold value prepared beforehand, the unsuitability being caused by the individual differences of sheet feed devices.

Decrease in the accuracy of the following control may cause problems in sheet feeding such as multiple feeding occurred due to too many floated sheets, no sheet feeding occurred due to too few floated sheets, and the like.

Moreover, in the sheet feed device above, floating unevenness of sheets may be generated when the sheets are floated due to worsening of the sheet alignment on the sheet feed tray caused by air blow and the like. And noise may be generated in the sensor value due to the floating unevenness of sheets in the above described control of the height position of the sheet feed tray in accordance with decrease in the number of sheets. Due to the influence of the noise, the accuracy of the control of the height position of the sheet feed tray may be decreased, which causes problems in sheet feeding such as multiple feeding of sheets, no sheet feeding, and the like.

The disclosure is directed to a sheet feed device which can decrease or suppress problems in sheet feeding.

A sheet feed device in accordance with some embodiments includes: a stacking tray on which a sheet stack is stacked and which is capable of being lifted and lowered; a floating unit configured to blow air to the sheet stack to float sheets of the sheet stack; a conveyor configured to convey a top sheet of the sheets floated by the floating unit to a supply destination; a detector configured to emit light from a side of the sheet stack toward the sheet stack and receive light reflected from the sheet stack; and a controller configured to drive the floating unit and the conveyor to perform a sheet feed operation, the controller being configured to, during the sheet feed operation, acquire an amount of received light at the detector during floating of sheets floated by the floating unit each time each sheet is conveyed by the conveyor and perform a following control of lifting the stacking tray upon the acquired amount of received light being less than a threshold value. The controller is configured to: after start of the sheet feed operation, sample amounts of received light at the detector during floating of the sheets floated by the floating unit; perform a threshold value determination process of determining the threshold value by using the sampled amounts of received light; and start the following control upon determining the threshold value.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; in each of the stop periods, acquire an amount of received light at the detector at a timing at which the sheets floated by the floating unit other than a sheet conveyed by the conveyor are falling; and control the driver based on the acquired amounts of received light.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; acquire amounts of received light at the detector in the stop periods; and control the driver based on an average value of the amounts of received light acquired in a plurality of the latest stop periods.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; and control the driver based on an average value of amounts of received light at a plurality of timings in each conveyance cycle.

According to the aforementioned configurations, problems in sheet feeding can be decreased or suppressed.

DETAILED DESCRIPTION

Figure 1:
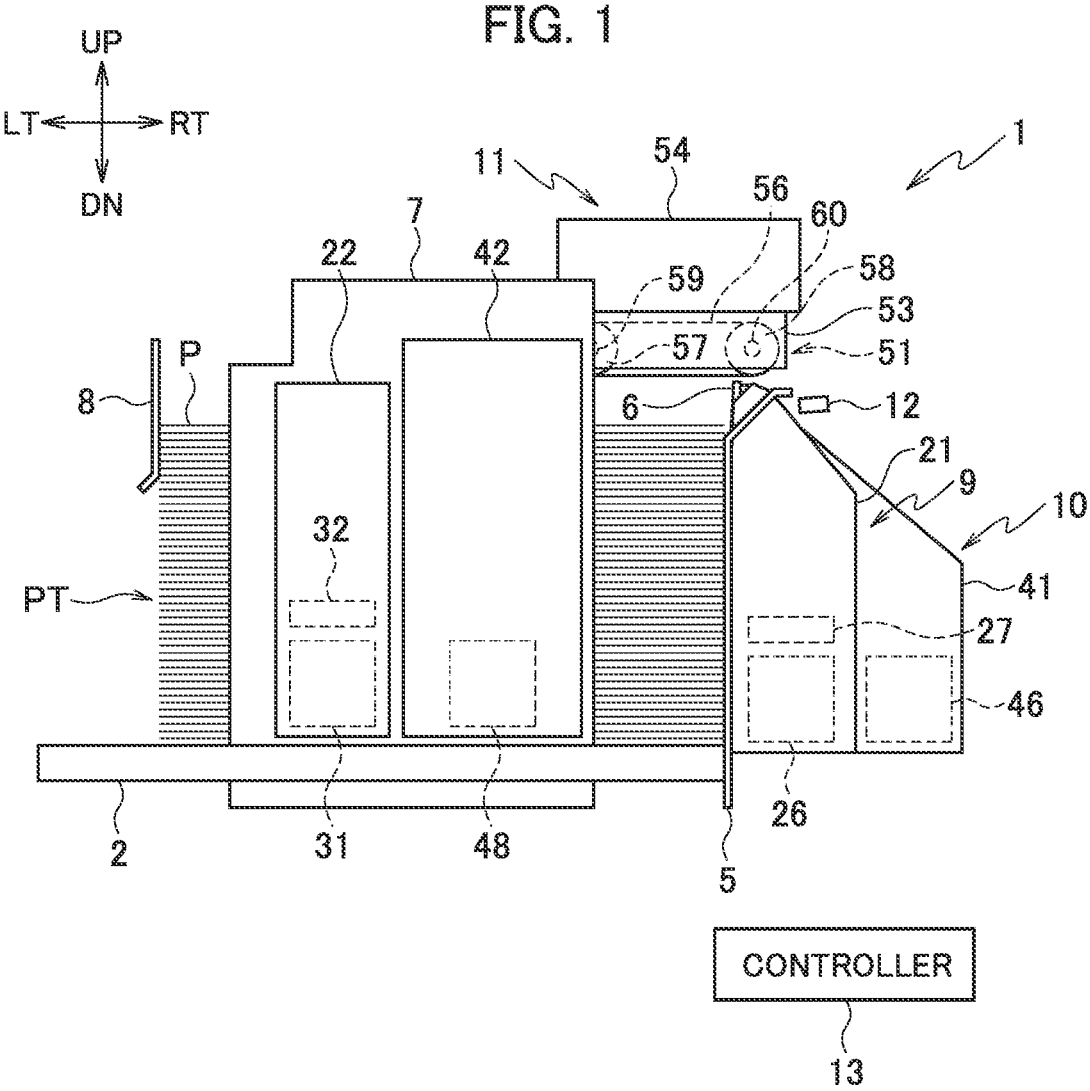
FIG. 1 is a schematic configuration diagram of a sheet feed device according to all of the embodiments.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
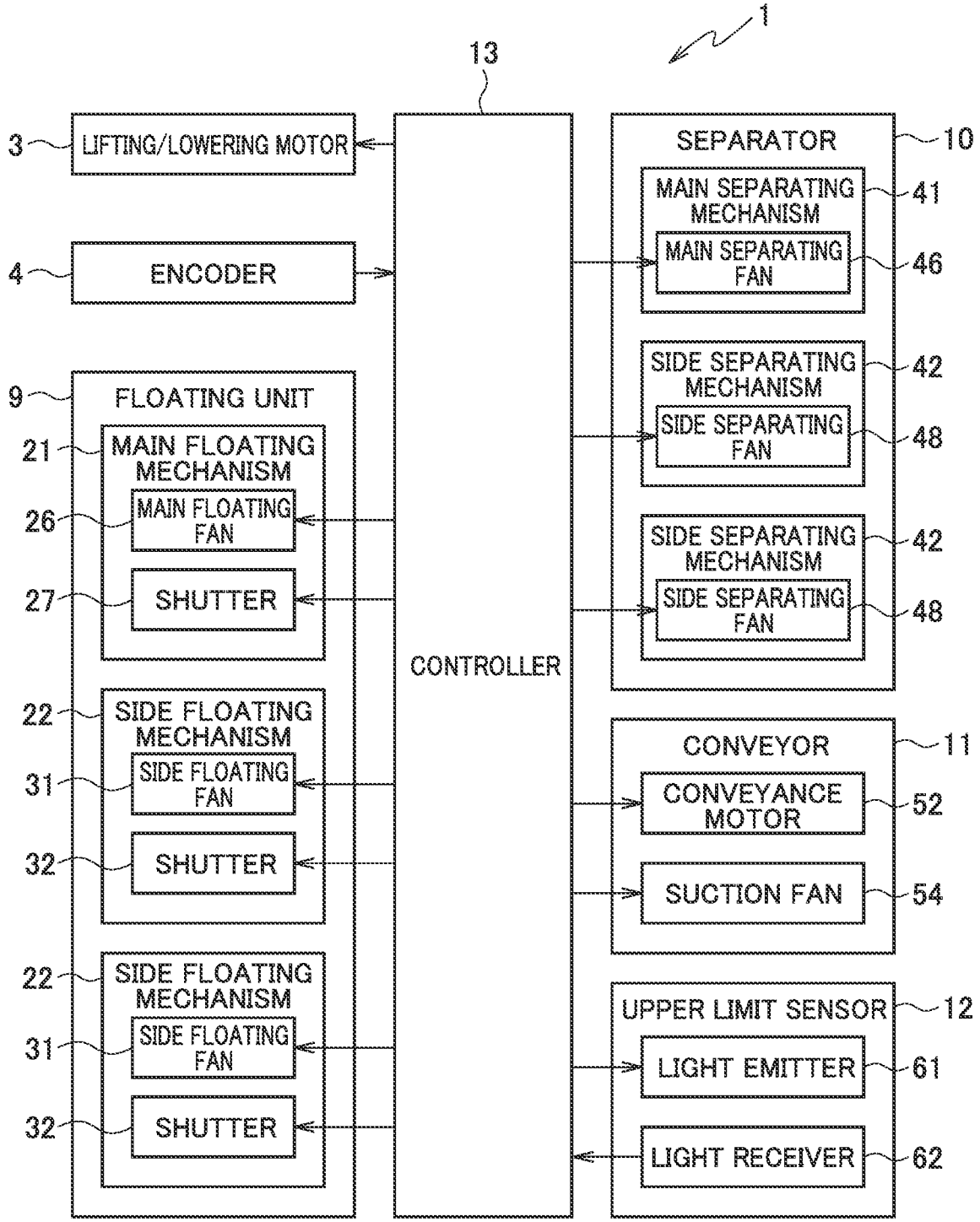
FIG. 2 is a control block diagram of the sheet feed device of FIG. 1.
Figure 3:
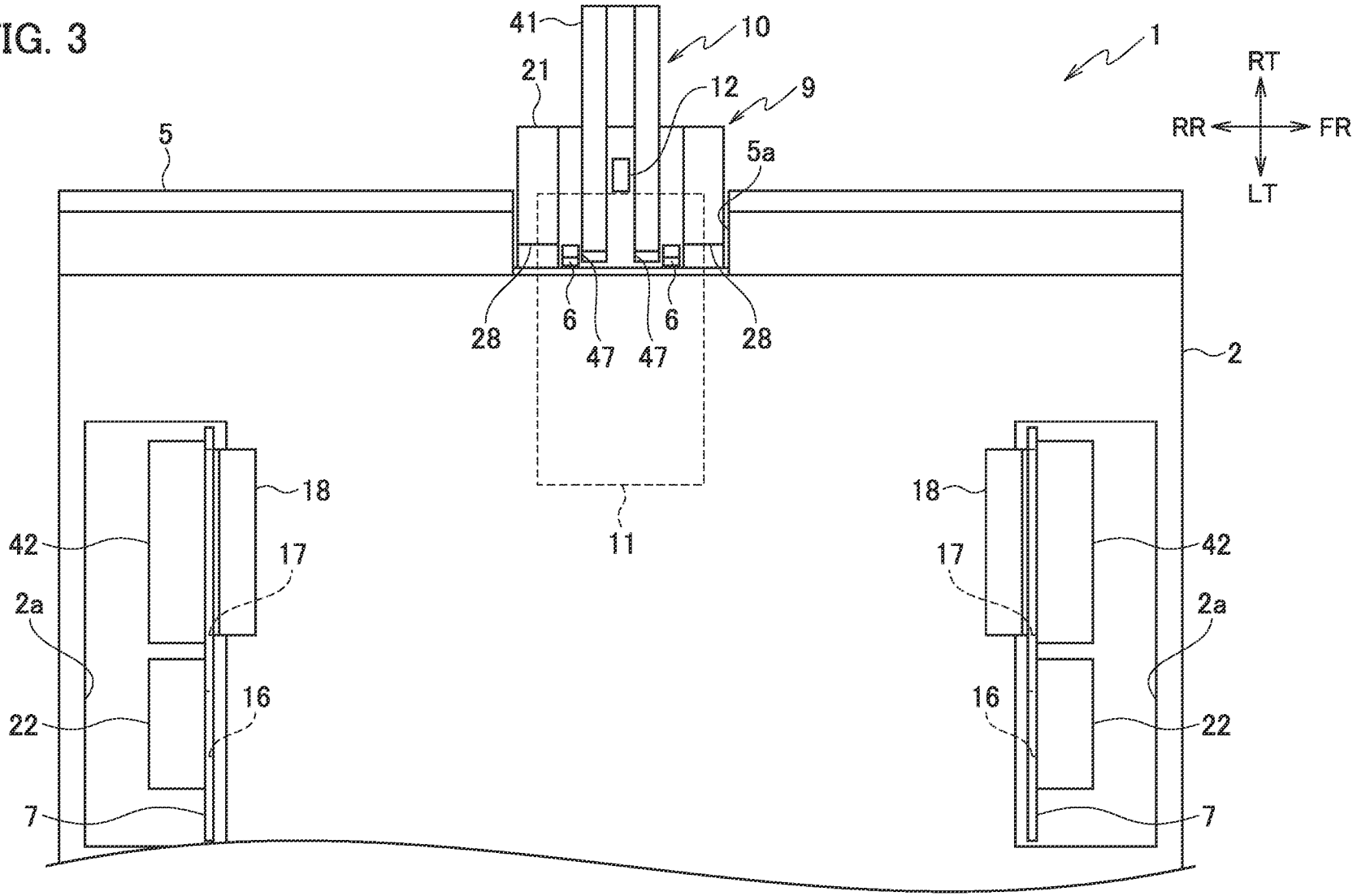
FIG. 3 is a partially enlarged plan view of the sheet feed device of FIG. 1.
Figure 4:
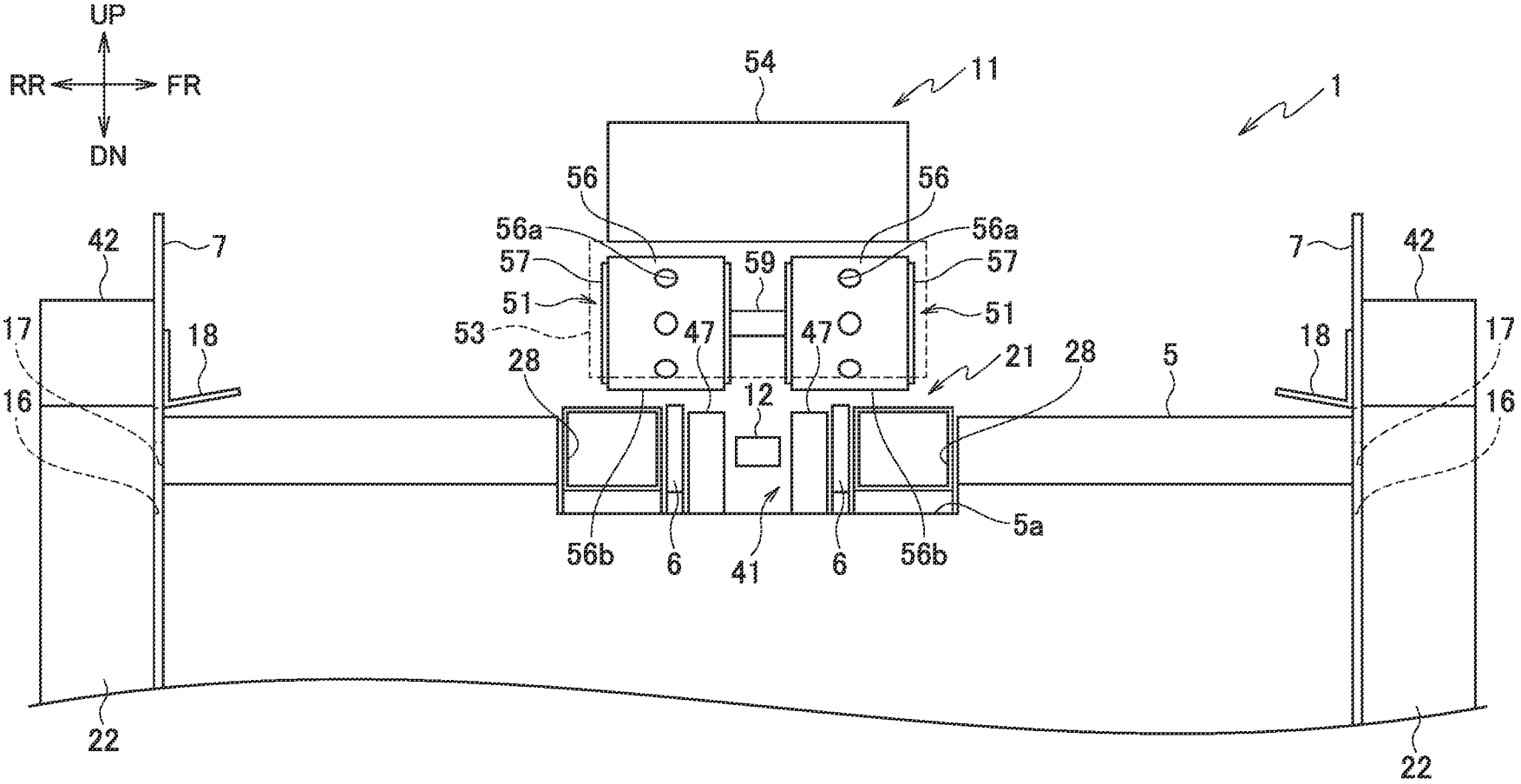
FIG. 4 is an enlarged view near a main float air blow opening of the sheet feed device of FIG. 1.
Figure 5:
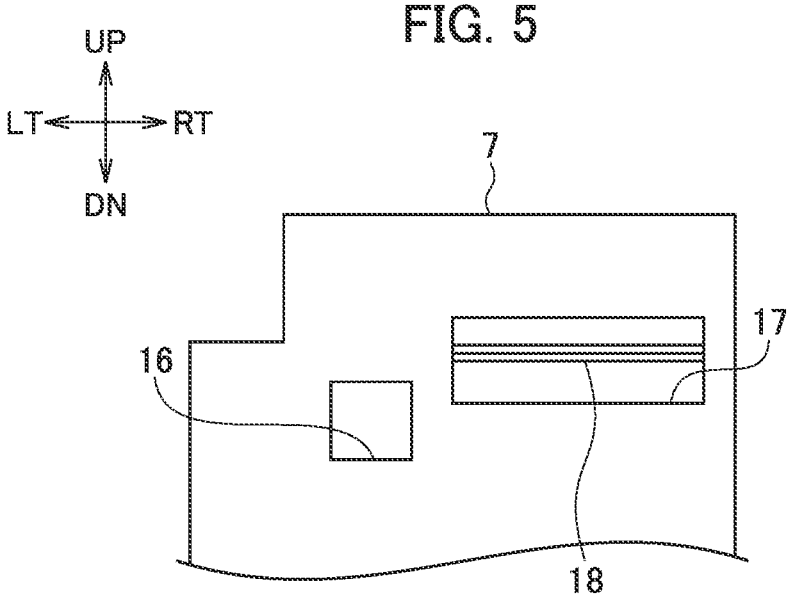
FIG. 5 is a partially enlarged view of a side fence of the sheet feed device of FIG. 1.
Figure 6:
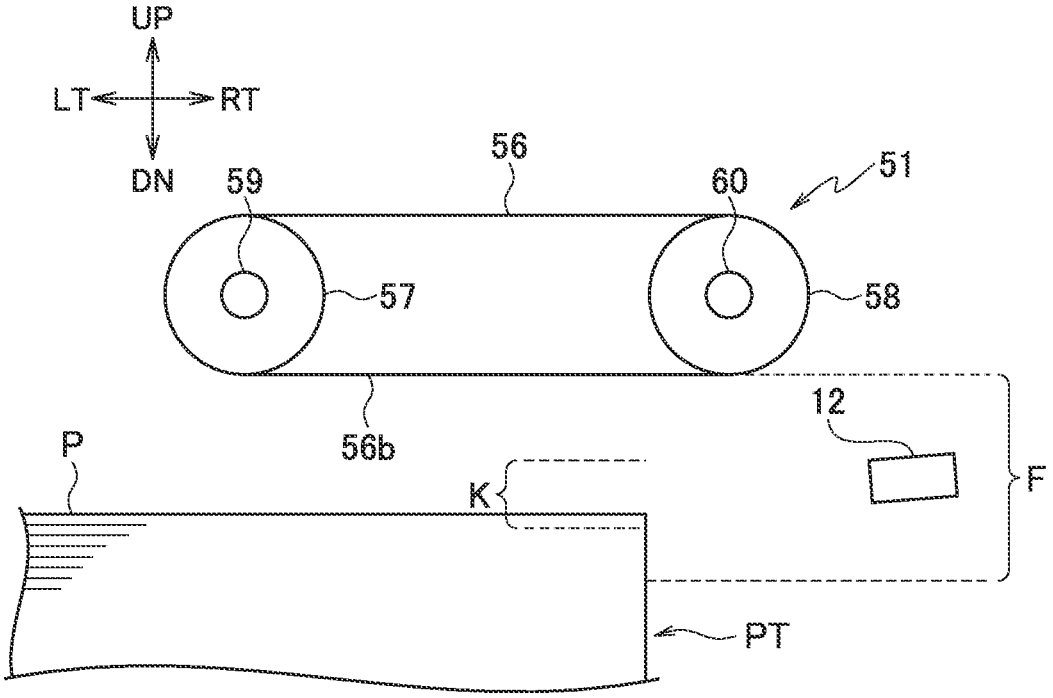
FIG. 6 is a view illustrating a float region of sheets on a sheet feed tray and a detection range of an upper limit sensor.

First, the configurations common to the all the embodiments are explained. FIG. 1 is a schematic configuration diagram of a sheet feed device 1 according to the all embodiments. FIG. 2 is a control block diagram of the sheet feed device 1 of FIG. 1. FIG. 3 is a partially enlarged plan view of the sheet feed device 1 of FIG. 1. FIG. 4 is an enlarged view near main float air blow openings 28 of the sheet feed device 1 of FIG. 1. FIG. 5 is a partially enlarged view of a side fence 7 of the sheet feed device 1 of FIG. 1. FIG. 6 is a view illustrating a float region F of sheets P on a sheet feed tray 2 and a detection range F of an upper limit sensor 12. In the following description, a direction orthogonal to the sheet surface of FIG. 1 is referred to as front-rear direction and a direction from the sheet surface toward the viewer is referred to as front. Moreover, right and left, and up and down in the sheet surface of FIG. 1 is referred to as up-down direction and as right-left direction. In FIGS. 1, 3 to 6, and 9, right, left, up, down, front, and rear direction are denoted by RT, LT, UP, DN, FR, and RR, respectively.

As illustrated in FIGS. 1 to 3, the sheet feed device (sheet supply device) 1 includes a sheet feed tray (stacking tray) 2, a lifting/lowering motor (driver) 3, an encoder 4, a feed guide plate 5, blocking gates 6, two side fences 7, an end fence 8, a floating unit 9, a separator 10, a conveyor 11, an upper limit sensor (detector) 12, and a controller 13.

The sheet feed device 1 is a device which feeds (supplies) sheets P to a printing unit of a printer (supply destination). The direction from the left toward the right in FIG. 1 is a conveyance direction of a sheet (sheets) P conveyed by the conveyor 11 in a sheet feed operation (sheet supply operation). Upstream and downstream in the following description mean upstream and downstream in the conveyance direction of the sheet P conveyed by the conveyor 11.

Sheets P to be used in printing are stacked on the sheet feed tray 2. The sheet feed tray 2 is capable of being lifted and lowered.

The sheet feed tray 2 has fence insertion holes 2*a*. The side fences 7 to which side floating mechanisms 22 and side separating mechanisms 42 described below are attached are inserted through the fence insertion holes 2*a*. The two fence insertion holes 2*a* correspond to the two side fences 7 respectively. One of the two fence insertion holes 2*a* is formed in a front end of the sheet feed tray 2 and the other of the two fence insertion holes 2*a* is formed in a rear end of the sheet feed tray 2.

The lifting/lowering motor 3 lifts and lowers the sheet feed tray 2.

The encoder 4 outputs a pulse signal for each prescribed rotation angle of a rotation shaft of the lifting/lowering motor 3.

The feed guide plate 5 is a member which regulates positions of downstream ends (right ends) of sheets P on the sheet feed tray 2. The feed guide plate 5 is arranged near the downstream of the sheet feed tray 2 and below a downstream end of belt units 51 described below. An upper end of the feed guide plate 5 is slanted to have a greater height towards downstream side.

As illustrated in FIGS. 3 and 4, the feed guide plate 5 has a recess 5*a* for blowing air from a main floating mechanism 21 described below towards sheets P on the sheet feed tray 2. The recess 5*a* is formed by cutting out an upper portion of the feed guide plate 5 in the center thereof in the front-rear direction.

The blocking gates 6 block sheets P other than a top sheet P adhered to (sucked onto) the conveyor 11 among sheets P floated by the floating unit 9. The two blocking gates 6 are arranged apart from each other in the front-rear direction near below a downstream end of the conveyor 11.

The side fences 7 are members which regulate positions of sheets P on the sheet feed tray 2 in the front-rear direction. The two side fences 7 are arranged apart from each other in the front-rear direction. As illustrated in FIG. 5, the side fences 7 have side float air blow openings 16 and side separation air blow openings 17. As illustrated in FIGS. 3 to 5, the side fences 7 have flow adjusters 18. FIG. 5 is a view of the side fence 7 located at the rear side viewed from the front side.

The side float air blow openings 16 are blow openings for side float air flows generated by the side floating mechanisms 22 described below. The side separation air blow openings 17 are blow openings for side separation air flows generated by the side separating mechanisms 42 described below.

The flow adjusters 18 are members which draw the top sheet P among sheets P on the sheet feed tray 2 floated by the floating unit 9 and allow the side separation air flows to flow between the top sheet P and the second sheet P from the top. The flow adjusters 18 are attached to inside (side of the sheet feed tray 2) surfaces of the side fences 7 along upper edges of the side separation air blow openings 17. The flow adjusters 18 are slanted to have greater heights towards the center of the sheet feed tray 2 in the front-rear direction.

The end fence 8 is a member which regulates positions of upstream ends (left ends) of sheets P on the sheet feed tray 2. The end fence 8 is arranged above the sheet feed tray 2. The end fence 8 is movable in the right-left direction.

The floating unit 9 blows air to a paper stack (sheet stack) PT consisting of sheets P stacked on top of one another on the sheet feed tray 2 and float sheets P of the sheet stack P. The floating unit 9 includes the main floating mechanism 21 and the side floating mechanisms 22.

The main floating mechanism 21 blows air for floating sheets P to sheets P on the sheet feed tray 2 from a downstream side of sheets P. The main floating mechanism 21 is arranged near the downstream of the sheet feed tray 2. The main floating mechanism 21 includes a main floating fan 26, a shutter 27, and the two main float air blow openings 28.

The main floating fan 26 generates main float air flows which are air blown to sheets P on the sheet feed tray 2 from the downstream side to float sheets P.

The shutter 27 switches between on and off of blowing the main float air flows from the main float air blow openings 28 (in other words, the shutter 27 performs to cause the main float air flows to blow or stop the main float air flows from blowing from the main float air blow openings 28). During drive of the main floating fan 26, the main float air flows are blown from the main float air blow openings 28 with the shutter 27 being opened and blowing of the main float air flows from the main float air blow openings 28 is stopped with the shutter 27 being closed.

The main float air blow openings 28 are blow openings for the main float air flows generated by drive of the main floating fan 26. The two main float air blow openings 28 are arranged apart from each other in the front-rear direction near below the downstream end of the conveyor 11.

The two side floating mechanisms 22 are arranged apart from each other in the front-rear direction with the sheet feed tray 2 interposed therebetween. The two side floating mechanisms 22 are installed on outer sides of the two side fences 7, respectively.

The side floating mechanism 22 located at the front side blows air for floating sheets P to sheets P on the sheet feed tray 2 from a front side of sheets P. The side floating mechanism 22 located at the rear side blows air for floating sheets P to sheets P on the sheet feed tray 2 from a rear side of sheets P. The side floating mechanisms 22 include side floating fans 31 and shutters 32.

The side floating fans 31 generate side float air flows which are air blown to sheets P on the sheet feed tray 2 from the side float air blow openings 16 of the side fences 7 to float sheets P.

The shutters 32 switch between on and off of blowing the side float air flows from the side float air blow openings 16 (in other words, the shutters 32 perform to cause the side float air flows to blow or stop the side float air flows from blowing from the side float air blow openings 16). During drive of the side floating fans 31, the side float air flows are blown from the side float air blow opening 16 with the shutters 32 being opened and blowing of the side float air flows from the side float air blow openings 16 is stopped with the shutters 32 being closed.

The separator 10 separates the top sheet P from the second and subsequent sheets P from the top among sheets P floated by the floating unit 9. The separator 10 includes a main separating mechanism 41 and the two side separating mechanisms 42.

The main separating mechanism 41 blows air from the downstream side to between the top sheet P floated by the floating unit 9 and adhered to the conveyor 11 and the second sheet P from the top. The main separating mechanism 41 includes a main separating fan 46 and two main separation air blow openings 47.

The main separating fan 46 generates main separation air flows which are air blown from the downstream side to between the top sheet P adhered to the conveyor 11 and the second sheet P from the top to separate the top sheet P from the second and subsequent sheets P from the top.

The main separation air blow openings 47 are blow openings for the main separation air flows generated by drive of the main separating fan 46. The two main separation air blow openings 47 are arranged apart from each other in the front-rear direction near below the downstream end of the conveyor 11. The main separation air blow openings 47 is configured to blow air upwardly towards the conveyor 11.

The two side separating mechanisms 42 are arranged apart from each other in the front-rear direction with the sheet feed tray 2 interposed therebetween. The two side separating mechanisms 42 are installed on the outer sides of the two side fences 7, respectively. The side separating mechanisms 42 are arranged at the right side of and adjacent to the side floating mechanisms 22.

The side separating mechanisms 42 blow, from the side separation air blow openings 17 of the side fences 7, the side separation air flows for drawing the top sheet P among sheets P floated by the floating unit 9 to the flow adjusters 18 and separating the top sheet P from the second sheet P from the top. The side separating mechanisms 42 include side separating fans 48 which generate the side separation air flows.

The conveyor 11 sucks by air suction the top sheet P among sheets P floated by the floating unit 9 and then conveys the top sheet P to a sheet feed destination (supply destination). The conveyor 11 includes the two belt units 51, a conveyance motor 52, a chamber 53, and a suction fan 54.

The belt units 51 conveys each sheet P while sucking and holding the each sheet P thereon. The two belt units 51 are arranged in a row in the front-rear direction. The belt units 51 are arranged over the right edge of the sheet feed tray 2 in the right-left direction. The belt units 51 include conveyance belts 56, drive rollers 57, and driven rollers 58.

The conveyance belts 56 are loop belts bridged between the drive rollers 57 and the driven rollers 58. The conveyance belts 56 have belt holes 56*a* formed in the whole circumference of the conveyance belts 56. The conveyance belts 56 suck and hold a sheet P on conveyance surfaces 56*b* which are lower surfaces of the conveyance belts 56 by suction force generated at the belt holes 56*a* due to drive of the suction fan 54. The sheet P is conveyed by rotation (endless movement) of the conveyance belts 56 by drive of the drive rollers 57 with the sheet P sucked and held on the conveyance surfaces 56*b*.

The drive rollers 57 rotate (endlessly move) the conveyance belts 56. The drive rollers 57 of the two belt units 51 are connected to each other by a shaft 59.

The driven rollers 58 support the conveyance belts 56 together with the drive rollers 57. The driven rollers 58 rotate to follow the conveyance belts 56 which are rotating. The driven rollers 58 of the two belt units 51 are connected to each other by a shaft 60.

The conveyance motor 52 rotates the drive rollers 57 by rotating the shaft 59.

The chamber 53 defines a negative pressure chamber for generating the suction force at the belt holes 56*a* of the belt units 51. The chamber 53 holds the belt units 51 therein with the conveyance surfaces 56*b* of the conveyance belts 56 exposed to the outside of the chamber 53. At portions of a bottom plate of the chamber 53 where the conveyance belts 56 pass, ventilation holes (not illustrated) are formed. The suction force is generated at the belt holes 56*a* by air suction into the chamber 53 through the belt holes 56*a* of the conveyance surfaces 56*b* of the conveyance belts 56 and the ventilation holes of the chamber 53.

The suction fan 54 exhausts air from the chamber 53. Exhausting air from the chamber 53 by the suction fan 54 causes air to be sucked from the outside of the chamber 53 into the chamber 53 through the belt holes 56*a* of the conveyance surfaces 56*b* of the conveyance belts 56 and the ventilation holes of the chamber 53. The suction fan 54 is arranged above the chamber 53.

The upper limit sensor 12 monitors downstream (right side) edge surfaces of sheets P stacked on the sheet feed tray 2. The upper limit sensor 12 is arranged downstream of the sheet feed tray 2 and at a prescribed height position where the upper limit sensor 12 is able to detect sheets P in a state of being floated within the float region F illustrated in FIG. 6. The float region F is a region where the floating unit 9 floats sheets P in the up-down direction. The upper limit of the float region F is height positions of the conveyance surfaces 56*b* and the lower limit of the float region F is height positions of lower ends of the main float air blow openings 28. The upper limit sensor 12 detects sheets P within the detection range K (a field of view of the upper limit sensor 12). The upper limit of the detection range K is located at a position lower than the position of the upper limit of the float region F and the lower limit of the detection range K is located at a position higher than the position of the lower limit of the float region F. The upper limit sensor 12 is a reflective photosensor and includes a light emitter 61 and a light receiver 62.

The light emitter 61 emits light from the right side of the sheet stack PT (sheets P) on the sheet feed tray 2 to the left (towards the sheet stack PT). The light receiver 62 receives light from the left (from the sheet stack PT).

The controller 13 controls the whole processing of the sheet feed device 1. The controller 13 includes a CPU, RAM, ROM, HDD, and the like.

Next, a first embodiment is described. The controller 13 controls to drive the floating unit 9 and the separator 10 to float sheets P in the upper portion of the sheet stack PT on the sheet feed tray 2 and suck the top sheet P to the conveyance surfaces 56*b* and drive the conveyor 11 to convey and feed the top sheet P to the sheet feed destination. In the operation above, the controller 13 performs an on and off control of the floating unit 9 for blowing air to sheets P for each sheet conveyed by the conveyor 11, in order to separate the top sheet P from the second and subsequent sheets P from the top.

The controller 13, during the sheet feed operation, acquires an amount of received light (a sensor value) at the light receiver 62 during floating of sheets P by the floating unit 9 each time each sheet P is conveyed by the conveyor 11 and performs a following control of lifting the sheet feed tray 2 when the acquired amount of received light is less than a following threshold value (threshold value). In the following control, the sheet feed tray 2 is lifted in response to decrease of the remaining sheets P on the sheet feed tray 2 due to sheet feeding, thereby maintaining a height position of an upper surface of the sheet stack PT on the sheet feed tray 2 to a target position during the sheet feed operation. The target position for the height position of the sheet stack PT is preliminarily set such that the height position of the upper surface of the sheet stack PT becomes suitable for sheet feeding in the sheet feed device 1. The target position is suitably determined based on experiment and the like depending on sheet types (sheet thickness).

After start of the sheet feed operation, the controller 13 samples amounts of received light (sensor values) at the light receiver 62 during floating of sheets P floated by the floating unit 9 and performs a threshold value determination process of determining the following threshold value by using the sampled amounts of received light. After determining the following threshold value through the threshold value determination process, the controller 13 starts the following control.

Specifically, the controller 13 sets a height positon of the sheet feed tray 2 at a timing of the start of the sheet feed operation such that the height position of the upper surface of the sheet stack PT becomes a sheet feed start position described below which is higher than the target position during the sheet feed operation. After the start of the sheet feed operation, in the threshold value determination process, the controller 13 samples a sensor value during floating of sheets P floated by the floating unit 9 with the height position of the sheet feed tray 2 being fixed, each time each of a plural number of sheets P (a sampling number of sheets described below) to be conveyed in a sampling period SP described below is conveyed. Then, the controller 13 determines an average value of the sampled sensor values of the sampling number of sheets to be the following threshold value.

Note that the sensor value (each sensor value) during floating of sheets P floated by the floating unit 9 is an amount of received light of a reflected light from the edge surfaces of sheets P in a state of being floated within the detection range K of the upper limit sensor 12. Hence, the sensor value during floating of sheets P becomes greater as the number of sheets P in a state of being floated within the detection range K of the upper limit sensor 12 becomes greater.

The number of sheets P which are capable of being floated due to air blowing by the floating unit 9 is the number of sheets P existed within the float region F. Hence, the number of sheets P floated due to air blowing by the floating unit 9 becomes less as a height position of the top sheet P (the upper surface of the sheet stack PT) on the sheet feed tray 2 with sheets P on the sheet feed tray 2 not being floated becomes lower.

For this reason, the sensor value (each sensor value) during floating of sheets P can be artificially used as information indicating the height position of the upper surface of the sheet stack PT on the sheet feed tray 2 for the case where sheets P on the sheet feed tray 2 are not floated. If the height position of the sheet feed tray 2 is not changed, the number of floated sheets P becomes less as sheet feeding is progressed and thus the sensor values are on the decline.

Thus, the sheet feed device 1, as aforementioned, performs the following control during the sheet feed operation by using the sensor values during floating of sheets P.

The sheet feed device 1 changes conditions such as an amount of air blow by the floating unit 9 for floating sheets P, a period of on state of air blow by the floating unit 9 to sheets P for each fed sheet P, and the like depending on combinations of sheet sizes and the sheet types (sheet thickness). Thus, the floating state of sheets P changes depending on the combinations of the sheet sizes and the sheet types. Further, the reflection rate of sheets P changes depending on sheet colors and sheet types (sheet quality) of sheets P. Hence, the suitable following threshold varies for combinations of the sheet sizes, the sheet types, and the sheet colors.

To address these issues, it is considered to prepare beforehand the following threshold value for every combination of the sheet sizes, the sheet types, and the sheet colors, in order to meet various sheet sizes and the like. However, combinations of the sheet sizes, the sheet types, and the sheet colors are numerous and thus numerous following threshold values are necessary for all the combinations.

Moreover, the accuracy of the following control may be decreased due to other various factors which influence the sensor values even if the following threshold value is prepared beforehand for every combination of the sheet sizes, the sheet types, and the sheet colors. As other various factors which influence the sensor values, there are a stack position of the sheet stack PT (a distance between the upper limit sensor 12 and the sheet stack PT), the age deterioration of the upper limit sensor 12, the characteristic change of the upper limit sensor 12 due to the ambient temperature change, adherence of paper powder to the upper limit sensor 12, and the like.

Moreover, the accuracy of the following control may be decreased due to the unsuitability of the following threshold value prepared beforehand, the unsuitability being caused by the individual differences of the sheet feed devices 1.

Decrease in the accuracy of the following control may cause problems in sheet feeding such as multiple feeding occurred due to too many floated sheets P, no sheet feeding occurred due to too few floated sheets P, and the like.

Thus, as aforementioned, the sheet feeding devise 1, after the start of the sheet feed operation, determines the following threshold value by sampling the sensor values during floating of sheets P in the threshold value determination process and then starts the following control.

Next, operations of the sheet feed device 1 according to the first embodiment are described with reference to the flowchart of FIG. 7.

Figure 7:
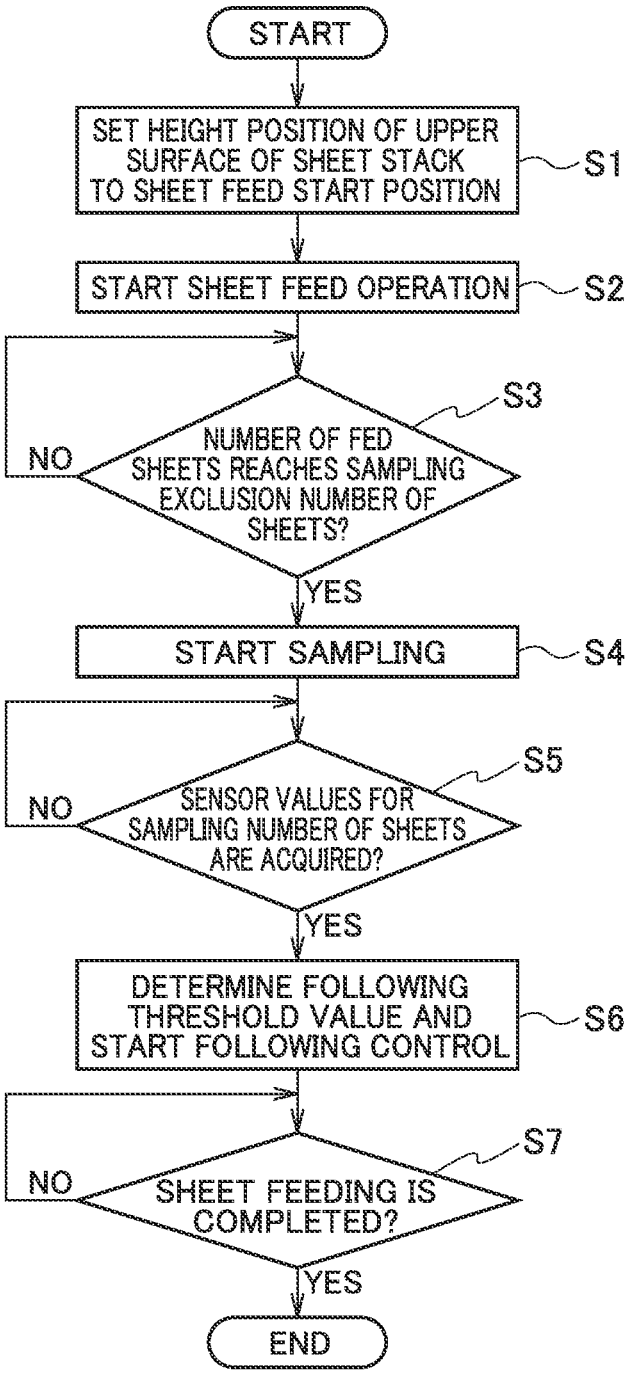
FIG. 7 is a flowchart illustrating processing of a sheet feed device according to a first embodiment.

In step S1 of FIG. 7, the controller 13, in response to an instruction of start of feeding, sets the height position of the upper surface of the sheet stack PT to the sheet feed start position which is higher than the target position during the sheet feed operation. The sheet feed start position is higher than the target position by the thickness of sheets P of the sum of the sampling exclusion number of sheets describe below and half the sampling number of sheets describe below.

Specifically, the controller 13 starts lifting the sheet feed tray 2 from a state where the upper surface of the sheet stack PT on the sheet feed tray 2 is below the lower limit of the detection rage K of the upper limit sensor 12.

After the start of lifting the sheet feed tray 2, when the upper portion of the sheet stack PT on the sheet feed tray 2 enters into the detection rage K of the upper limit sensor 12, a reflected light from the right side surface (edge surface) of the upper portion of the sheet stack PT is started to be received by the light receiver 62. Then, the rage of the sheet stack PT on the sheet feed tray 2 within the detection rage K is broadened in accordance with lifting of the sheet feed tray 2 and thus the sensor values of the upper limit sensor 12 become greater.

When determining that the sensor value reaches a prescribed non-float threshold value, the controller 13 stops lifting the sheet feed tray 2. The non-float threshold value is set as an amount of received light (a sensor value) at the light receiver 62 with the height position of the upper surface of the sheet stack PT being at a prescribed sensor position within the detection rage K of the upper limit sensor 12. Hence, the sheet feed tray 2 is stopped with the height position of the upper surface of the sheet stack PT being at the sensor position by stopping lifting the sheet feed tray 2 when the sensor value reaches the non-float threshold value as aforementioned.

As aforementioned, the target position is determined depending on the sheet types (sheet thickness) and thus the target position may be higher or lower than the sensor position. Hence, the sheet feed start position may also be higher or lower than the sensor position.

Thus, the controller 13 starts lifting or lowering the sheet feed tray 2 and then stop the sheet feed tray 2 when the height position of the upper surface of the sheet stack PT reaches the sheet feed start position. Accordingly, the height position of the upper surface of the sheet stack PT is set to the sheet feed start position. Note that the controller 13 determines whether the height position of the upper surface of the sheet stack PT reaches the sheet feed start position based on the number of pulses output from the encoder 4 from a timing of starting lifting or lowering the sheet feed tray 2.

Next, in step S2, the controller 13 starts the sheet feed operation. Specifically, the controller 13 starts drive of the main floating fan 26, the two side floating fans 31, the main separating fan 46, the two side separating fans 48, and the suction fan 54 with the shutter 27 and the two shutters 32 being opened.

By the operation above, the main float air flows, the side float air flows, the main separation air flows, and the side separation air flows are blown from the main float air blow openings 28, the side float air blow openings 16, the main separation air blow openings 47, and the side separation air blow openings 17, respectively. Moreover, the suction force is generated at the belt holes 56*a* of the belt units 51.

By the main float air flows and the side float air flows, plural sheets P at the uppermost portion of the sheet stack PT on the sheet feed tray 2 within the float region F are floated. Then, the top sheet P among the floated sheets P is sucked onto the conveyance surfaces 56*b* of the belt units 51.

When sheets P are floated, the side separation air flows blown from the side separation air blow openings 17 flow along the flow adjusters 18 in the vicinity of the side fences 7, thereby producing a negative pressure state between the flow adjusters 18 and the top sheet P. Thus, the top sheet P is drawn to the flow adjusters 18 and comes into contact with the flow adjusters 18. As a result, the side separation air flows are flown between the top sheet P and the second sheet P from the top.

At the main separating mechanism 41, the main separation air flows blown from the main separation air blow openings 47 flow along the top sheet P sucked onto the conveyance surfaces 56*b* to the upstream side (the left) after the top sheet P is sucked onto the conveyance surfaces 56*b*.

The main separation air flows, the side separation air flow from the front side, and the side separation air flow from the rear side therefore collide with each other between the top sheet P and the second sheet P from the top to generate a positive pressure therebetween.

In this state, the controller 13 controls to close the shutters 27, 32. Then, the controller 13 controls the conveyance motor 52 to start drive of the belt units 51.

In response to the start of drive of the belt units 51, the top sheet P sucked onto the conveyance surfaces 56*b* starts to be conveyed to the right.

Moreover, by closing the shutters 27, 32, blowing of the main float air flows from the main float air blow openings 28 and blowing of the side float air flows from the side float air blow openings 16 to sheets P on the sheet feed tray 2 are stopped. In other words, blowing air by the floating unit 9 to sheets P on the sheet feed tray 2 is turned off (is stopped). Thus, the positive pressure generated between the top sheet P and the second sheet P from the top presses down on the second and subsequent sheets P from the top to separate the top sheet P from the second and subsequent sheets P from the top.

As the above manner, the top sheet P is conveyed by the belt units 51 while the second and subsequent sheets P from the top are falling.

Next, the controller 13 stops the belt units 51 at a prescribed timing after the start of drive of the belt units 51. Then, the controller 13 opens the shutters 27, 32 to float sheets P for feeding the next sheet P.

By repeating the above operations, each sheet P is sequentially fed from the sheet feed device 1 to the sheet feed destination. Note that, as aforementioned, the controller 13 changes the conditions such as the amount of air blow by the floating unit 9 for floating sheets P, the period of on state of air blow by the floating unit 9 to sheets P for each fed sheet P, and the like depending on the combinations of the sheet sizes and the sheet types (sheet thickness).

After the start of the sheet feed operation, in step S3, the controller 13 determines whether the number of fed sheets P from the start of the sheet feed operation of this time reaches the sampling exclusion number of sheets.

The sampling exclusion number of sheets is set beforehand as the number of fed sheets P for which sampling the sensor values for determining the following threshold value is not performed immediately after the start of the sheet feed operation. As described below, the behavior of floated sheets P immediately after the start of the sheet feed operation is unstable and thus the sampling exclusion number of sheets is set, thereby refraining from sampling the sensor values until sheets P of the sampling exclusion number of sheets are fed. The sampling exclusion number of sheets is set beforehand as the number of fed sheets P from the start of the sheet feed operation to start of sampling the sensor values. The behavior of floated sheets P varies depending on the sheet types (sheet thickness) and thus the sampling exclusion number of sheets is set depending on the sheet types (sheet thickness). The sampling exclusion number of sheets may be one or plural.

Next, in step S4, the controller 13 starts sampling the sensor values for determining the following threshold value. This starts the sampling period SP and the threshold value determination process. The sampling period SP is set as described below.

Specifically, the controller 13 acquires the sensor value of the upper limit sensor 12 during floating of sheets P floated for feeding the sheet P next to the last sheet P of the sampling exclusion number of sheets. Then, the controller 13 acquires the sensor value during floating of sheets P each time each sheet P is conveyed (fed) by the conveyor 11. As each sensor value during floating of sheets P, the controller 13 acquires a sensor value a prescribed time after a timing of opening the shutters 27, 32, for example.

Next, in step S5, the controller 13 determines whether the sensor values of the sampling number of sheets are acquired. When the controller 13 determines that the sensor values of the sampling number of sheets are not acquired (step S5: NO), the controller 13 repeats step S5.

The sampling number of sheets is set beforehand as the number of fed sheets P for which sampling the sensor values for determining the following threshold value is performed. The sampling number of sheets is plural. The sampling number of sheets may be set the same regardless of the sheet types and the like or may be set different depending on the sheet types (sheet thickness). The sampling period SP is ended when the number of fed sheets P from the start of the sampling period SP reaches the sampling number of sheets.

When the controller 13 determines that the sensor values of the sampling number of sheets are acquired (step S5: YES), in step S6, the controller 13 determines the following threshold value and starts the following control.

Specifically, the controller 13 calculates the average value of the sensor values of the sampling number of sheets acquired in the sampling period SP and determines the calculated average value as the following threshold value. This completes the threshold value determination process. Then, the controller 13 starts the following control using the determined following threshold value. Note that the height position of the sheet feed tray 2 is fixed (maintained) to a position set at the start of the sheet feed operation until the start of the following control.

After the controller 13 starts the following control, the controller 13 lifts the sheet feed tray 2 when the acquired sensor value is less than the following threshold value each time each sheet P is fed.

Specifically, when the acquired sensor value is less than the following threshold value, the controller 13 drives the lifting/lowering motor 3 to lift the sheet feed tray 2 for a prescribed drive period. When driving the lifting/lowering motor 3, the controller 13 controls a drive voltage of the lifting/lowering motor 3 depending on the difference between the acquired sensor value and the following threshold value.

Specifically, the controller 13 controls to increase the drive voltage of the lifting/lowering motor 3 to increase a lift amount of the sheet feed tray 2 as the difference between the sensor value and the following threshold value is greater. As the difference between the sensor value and the following threshold value is greater, the number of sheets P within the float region F is less and the height position of the upper surface of the sheet stack PT on the sheet feed tray 2 for the case where sheets P on the sheet feed tray 2 are not floated are lower. Hence, the controller 13 controls to increase the lift amount of the sheet feed tray 2 as the difference between the sensor value and the following threshold value is greater. The relation between the difference between the sensor value and the following threshold value and the drive voltage of the lifting/lowering motor 3 is set beforehand based on experiment and the like depending on the sheet types (sheet thickness) such that the height position of the upper surface of the sheet stack PT reaches the target position by the lift of the sheet feed tray 2.

Next, in step S7, the controller 13 determines whether sheet feeding of the number of sheets P to be fed for the sheet feed operation of this time is completed. When the controller 13 determines that sheet feeding of the number of sheets P to be fed for the sheet feed operation is not completed (step S7: NO), the controller 13 repeats step S7. When the controller 13 determines that sheet feeding of the number of sheets P to be fed for the sheet feed operation is completed (step S7: YES), the series of operations is completed.

Figure 8:
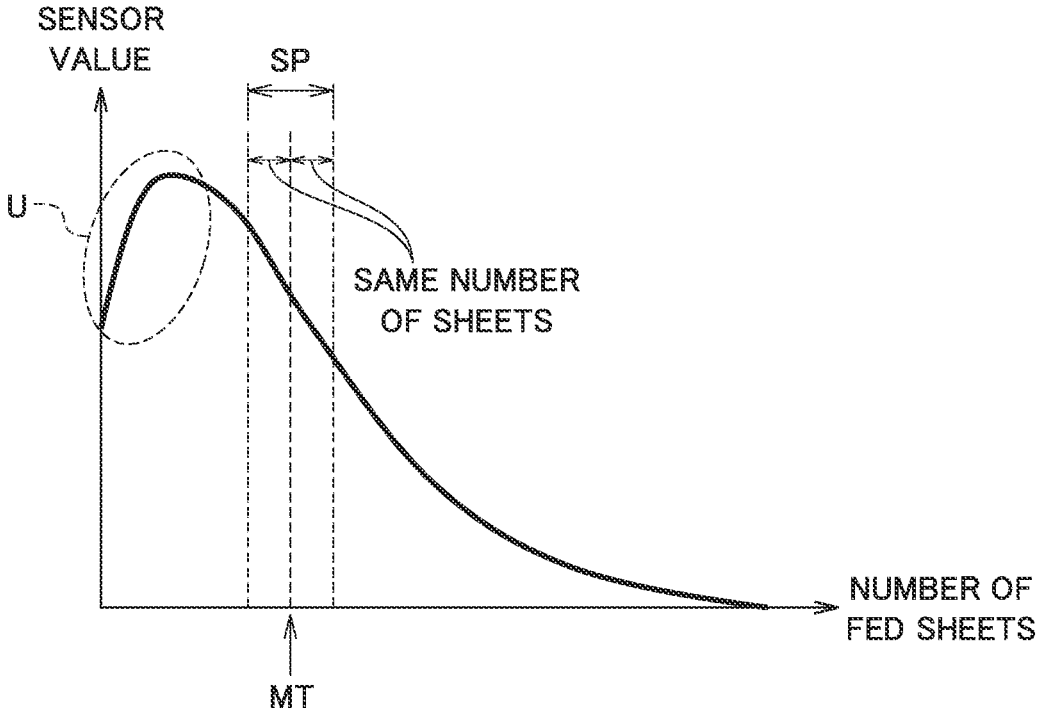
FIG. 8 is a diagram illustrating an example of a transition of sensor value acquired for each fed sheet during floating of sheets.

FIG. 8 illustrates an example of a transition of the sensor value acquired for each fed sheet P during floating of sheets P in a case where the sheet feed operation is started with the height position of the upper surface of the sheet stack PT being the sheet feed start position higher than the target position. Note that FIG. 8 illustrates the transition of the sensor values in a case where the sheet feed operation is continued to be performed with the height positon of the sheet feed tray 2 being fixed (maintained) to the position set at the start of the sheet feed operation without starting the following control even after the end of the sampling period SP.

In the state where the height positon of the sheet feed tray 2 is fixed (maintained), the height position of the upper surface of the sheet stack PT becomes lower and the number of sheets P within the float region F is decreased as sheet feeding is progressed. Hence, the number of sheets P floated by the floating unit 9 is decreased as the number of fed sheets P from the start of the sheet feed operation is increased. Thus, the sensor value acquired for each fed sheet P during floating of sheets P becomes less as the number of fed sheets P from the start of the sheet feed operation is increased.

However, the behavior of floated sheets P immediately after the start of the sheet feed operation tends to be unstable. For example, plural sheets P may be floated with the plural sheets P closely attached to each other because air is not entered well in between the plural sheets P. The sensor value acquired in this case is less than the sensor value acquired in a case where all the floated sheets P are separated from each other. For this reason, as by U in FIG. 8, the sensor values immediately after the start of the sheet feed operation tend to be unstable such as sensor values less than estimated values and the like. Especially, the sensor value acquired at the time of feeding the first sheet P tends to be unstable.

Accordingly, as aforementioned, in the sheet feed device 1, the sampling exclusion number of sheets described above is set in order to avoid sampling of the sensor values immediately after the start of the sheet feed operation.

In the sheet feed device 1, as illustrated in FIG. 8, the sampling period SP including a timing MT at which the height position of the upper surface of the sheet stack PT becomes the target position is also set. That is, the sampling period SP is a period in which the height position of the upper surface of the sheet stack PT is lowered over the target position. Moreover, the sampling period SP is set such that the same number of sheets P are fed in the sampling period SP before and after the timing MT at which the height position of the upper surface of the sheet stack PT becomes the target position.

As described above, in the sheet feed device 1, after the start of the sheet feed operation, the controller 13 samples the sensor values during floating of sheets P floated by the floating unit 9 and performs the threshold value determination process of determining the following threshold value by using the sampled sensor values. After determining the following threshold value through the threshold value determination process, the controller 13 starts the following control using the determined following threshold value. Hence, the following control using the suitable following threshold value can be performed depending on the actual conditions in the sheet feed operation such as the combinations of the sheet sizes, the sheet types, and the sheet colors, the stack position of the sheet stack PT (the distance between the upper limit sensor 12 and the sheet stack PT), and the like, without preparing the following threshold values corresponding to such conditions beforehand. The influences caused by the individual differences of the sheet feed devices 1 can be also removed. Accordingly, decrease in the accuracy of the following control can be prevented and therefore problems in sheet feeding can be decreased or suppressed.

Specifically, the controller 13 sets the height positon of the sheet feed tray 2 at the timing of the start of the sheet feed operation such that the height position of the upper surface of the sheet stack PT becomes the sheet feed start position higher than the target position during the sheet feed operation. After start of the sheet feed operation, in the threshold value determination process, the controller 13 samples the sensor value during floating of sheets P with the height position of the sheet feed tray 2 being fixed, each time each of the plural number of sheets P (the sampling number of sheets) to be conveyed in the sampling period SP is conveyed. Then, the controller 13 determines the average value of the sampled sensor values of the sampling number of sheets to be the following threshold value. Accordingly, the suitable following threshold value can be determined and the following control using the suitable following threshold value can be performed while performing the sheet feed operation.

Moreover, the controller 13 starts the sampling period SP after conveyance of sheets P of the sampling exclusion number of sheets from the start of the sheet feed operation. Accordingly, the highly accurate and suitable following threshold value can be calculated by avoiding sampling of the unstable sensor values immediately after the start of the sheet feed operation.

In the embodiment described above, the sampling period SP is set such that the same number of sheets P are fed in the sampling period SP before and after the timing MT at which the height position of the upper surface of the sheet stack PT becomes the target position and the average value of the sampled sensor values to be the following threshold value. However, the respective numbers of sheets P fed in the sampling period SP before and after the timing MT at which the height position of the upper surface of the sheet stack PT becomes the target position may be different from each other. In this case, the following threshold value may be determined by adjusting the average value of the sampled sensor values of the sampling number of sheets depending on the respective numbers of sheets P fed in the sampling period SP before and after the timing MT at which the height position of the upper surface of the sheet stack PT becomes the target position. The sampling period SP may be a period in which the height position of the upper surface of the sheet stack PT lowered in accordance with progress of sheet feeding with the height positon of the sheet feed tray 2 being fixed (maintained) after the start of the sheet feed operation is lowered over the target position.

Moreover, if the behavior of floated sheets P even immediately after the start of the sheet feed operation is stable, setting of the sampling exclusion number of sheets immediately after the start of the sheet feed operation may be omitted and the sampling period SP may be started together with (at the same time with, for example) the start of the sheet feed operation. For example, the sampling period SP may be started together with (at the same time with, for example) the start of the sheet feed operation in a configuration where blowing air in between sheets P of the sheet stack PT before the start of the sheet feed operation can avoid floating of plural sheets P with the plural sheets P being closely attached to each other and thus can stabilize the behavior of floated sheets P.

Moreover, as aforementioned, if the behavior of floated sheets P even immediately after the start of the sheet feed operation is stable, the sensor value sampled at the time of conveyance of the first sheet P in the sheet feed operation may be determined to be the following threshold value. In this case, the height positon of the sheet feed tray 2 at the timing of the start of the sheet feed operation is set such that the height position of the upper surface of the sheet stack PT becomes the target position during the sheet feed operation. Then, the sensor value during floating of sheets P floated for conveyance of the first sheet P in the sheet feed operation is sampled, the sampled sensor value is determined to be the following threshold value, and the following control is started. The threshold value determination process may be a process where the sensor value(s) during floating of sheets P floated by the floating unit 9 after the start of the sheet feed operation is sampled and the following threshold value is determined by using the sampled sensor value(s).

Moreover, modes may be selected in response to an indication by a user or the like between an operation mode where the following threshold value is determined through the threshold value determination process after the start of the sheet feed operation and then the following control is performed as described in the embodiment above and an operation mode where the following control is performed using a following threshold value prepared beforehand.

Next, a second embodiment is described. The controller 13 controls to drive the floating unit 9 and the separator 10 to float sheets P on the sheet feed tray 2 and suck the top sheet P to the conveyance surfaces 56*b* and drive the conveyor 11 to convey and feed the top sheet P to the sheet feed destination. In the operation above, the controller 13 performs an on and off control of the floating unit 9 for blowing air to sheets P for each sheet conveyed by the conveyor 11, in order to separate the top sheet P from the second and subsequent sheets P from the top. That is, as described below, the controller 13 controls to drive the floating unit 9 to stop blowing air in a float airflow stop period (stop period) set in each conveyance cycle of sheets P conveyed by the conveyor 11.

Moreover, the controller 13 performs a following control of lifting the sheet feed tray 2 in response to decrease of the remaining sheets P on the sheet feed tray 2 due to sheet feeding. As described below, in the following control, the controller 13 acquires an amount of received light (a sensor value) at the light receiver 62 at a prescribed sensor value acquisition timing SVT in each of the float airflow stop periods and controls the lifting/lowering motor 3 based on the acquired sensor value.

Next, operations of the sheet feed device 1 according to the second embodiment are described.

First, the controller 13, in response to an instruction of start of feeding, performs an initial positioning operation. The initial positioning operation is an operation for aligning the height position of the top sheet P (the upper surface of the sheet stack PT) on the sheet feed tray 2 with an upper limit position which is a position suitable for sheet feeding.

Specifically, the controller 13 first controls the lifting/lowering motor 3 to start lifting the sheet feed tray 2. At start of the initial positioning operation, the sheet feed tray 2 is located at a height position at which the sheet stack PT on the sheet feed tray 2 is out of the field of view (the detection range K) of the upper limit sensor 12.

After the start of lifting the sheet feed tray 2, when the upper portion of the sheet stack PT on the sheet feed tray 2 enters into the field of view of the upper limit sensor 12, a reflected light from the right edge surface of the upper portion of the sheet stack PT is started to be received by the light receiver 62. Then, the rage of the sheet stack PT on the sheet feed tray 2 within the field of view of the upper limit sensor 12 is broadened in accordance with lifting of the sheet feed tray 2 and thus the sensor values of the upper limit sensor 12 become greater.

Then, when the sensor value of the upper limit sensor reaches a prescribed non-float threshold value, the controller 13 stops lifting the sheet feed tray 2.

The non-float threshold value is set as an amount of received light (a sensor value) at the light receiver 62 with the height position of the top sheet P on the sheet feed tray 2 (the upper surface of the sheet stack PT) being at a prescribed sensor position within the field of view of the upper limit sensor 12. Hence, the sheet feed tray 2 is stopped with the height position of the top sheet P on the sheet feed tray 2 being at the prescribed sensor position by stopping lifting the sheet feed tray 2 when the sensor value reaches the non-float threshold value as aforementioned. Then, the controller 13 aligns the height position of the top sheet P on the sheet feed tray 2 with the upper limit position. Specifically, the controller 13 moves the sheet feed tray 2 by a distance between the upper limit position depending on sheet types (sheet thickness) and the prescribed sensor position, based on the number of pulses output from the encoder 4 connected to the lifting/lowering motor 3. The initial positioning operation is thereby completed.

After the initial positioning operation is completed, the controller 13 starts a sheet feed operation. Specifically, the controller 13 starts drive of the main floating fan 26, the two side floating fans 31, the main separating fan 46, the two side separating fans 48, and the suction fan 54 with the shutter 27 and the two shutters 32 being opened.

By the operation above, the main float air flows, the side float air flows, the main separation air flows, and the side separation air flows are blown from the main float air blow openings 28, the side float air blow openings 16, the main separation air blow openings 47, and the side separation air blow openings 17, respectively. Moreover, the suction force is generated at the belt holes 56*a* of the belt units 51.

Figure 9:
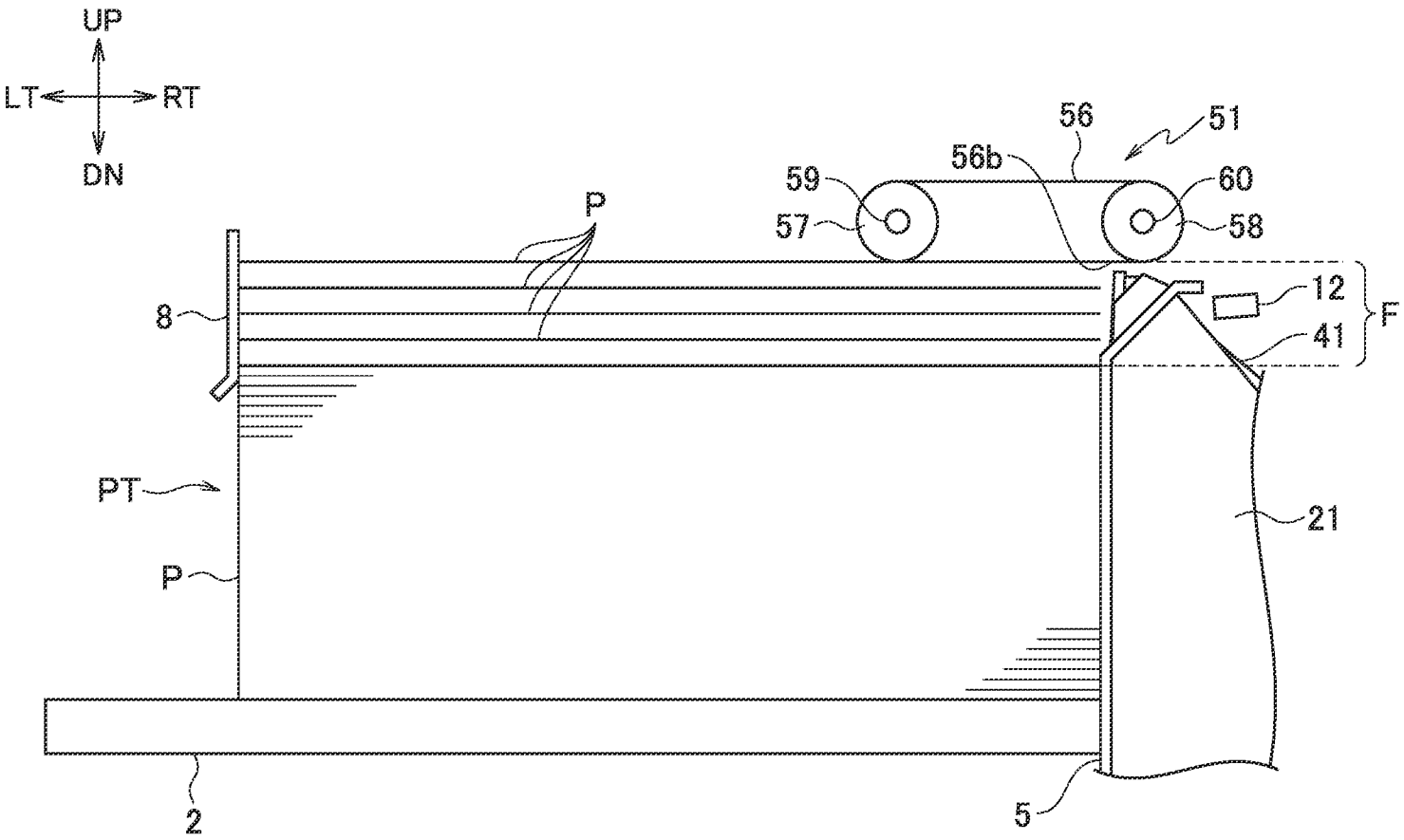
FIG. 9 is a view illustrating a floating state of sheets according to a second embodiment.

As illustrated in FIG. 9, by the main float air flows and the side float air flows, plural sheets P at the uppermost portion of sheets P on the sheet feed tray 2 within the float region F are floated. Then, the top sheet P among the floated sheets P is sucked onto the conveyance surfaces 56*b* of the belt units 51. The float region F is a region where the floating unit 9 floats sheets P in the up-down direction.

When sheets P are floated, the side separation air flows blown from the side separation air blow openings 17 flow along the flow adjusters 18 in the vicinity of the side fences 7, thereby producing a negative pressure state between the flow adjusters 18 and the top sheet P. Thus, the top sheet P is drawn to the flow adjusters 18 and comes into contact with the flow adjusters 18. As a result, the side separation air flows are flown between the top sheet P and the second sheet P from the top.

At the main separating mechanism 41, the main separation air flows blown from the main separation air blow openings 47 flow along the top sheet P sucked onto the conveyance surfaces 56*b* to the upstream side (the left) after the top sheet P is sucked onto the conveyance surfaces 56*b*.

The main separation air flows, the side separation air flow from the front side, and the side separation air flow from the rear side therefore collide with each other between the top sheet P and the second sheet P from the top to generate a positive pressure therebetween.

In this state, the controller 13 controls to close the shutters 27, 32. Then, the controller 13 controls the conveyance motor 52 to start drive of the belt units 51.

In response to the start of drive of the belt units 51, the top sheet P sucked onto the conveyance surfaces 56*b* starts to be conveyed to the right.

Moreover, by closing the shutters 27, 32, blowing of the main float air flows from the main float air blow openings 28 and blowing of the side float air flows from the side float air blow openings 16 to sheets P on the sheet feed tray 2 are stopped. In other words, blowing air by the floating unit 9 to sheets P on the sheet feed tray 2 is turned off (is stopped). Thus, the positive pressure generated between the top sheet P and the second sheet P from the top presses down on the second and subsequent sheets P from the top to separate the top sheet P from the second and subsequent sheets P from the top.

As the above manner, the top sheet P is conveyed by the belt units 51 while the second and subsequent sheets P from the top are falling.

Next, the controller 13 stops the belt units 51 at a prescribed timing after the start of drive of the belt units 51. Then, the controller 13 opens the shutters 27, 32 to float sheets P for feeding the next sheet P.

By repeating the above operations, each sheet P is sequentially fed from the sheet feed device 1 to the sheet feed destination.

Figure 10:
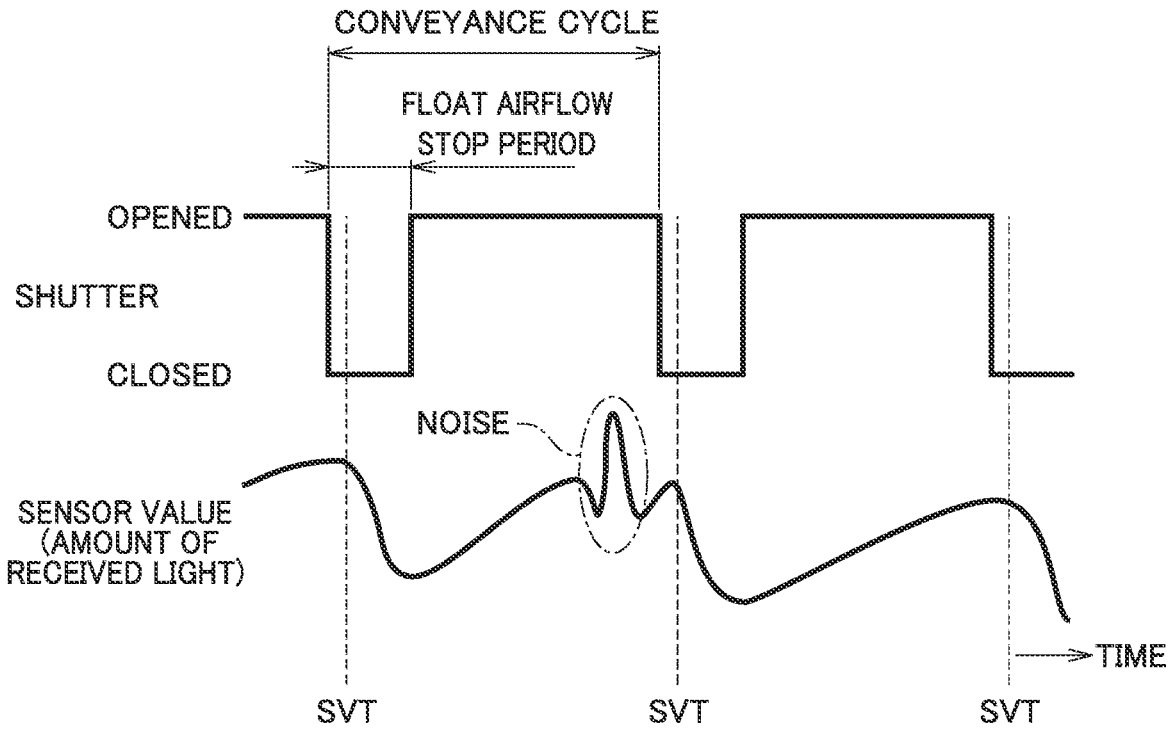
FIG. 10 is a diagram illustrating timings of acquiring sensor values according to the second embodiment.

As illustrated in FIG. 10, the closing of the shutters 27, 32 is periodically performed in each conveyance cycle of sheets P conveyed by the conveyor 11 (i.e. each time each sheet P is conveyed by the conveyor 11). That is, the float airflow stop period is a period in which blowing air by the floating unit 9 to sheets P on the sheet feed tray 2 is turned off (stopped) by the closing of the shutters 27, 32 and is set in each conveyance cycle of sheets P.

The float airflow stop period is a period from a timing when the top sheet P among sheets P floated by the main float air flows and the side float air flows is sucked onto the conveyance surfaces 56*b* to a timing when blowing of the main float air flows and the side float air flows is started for feeding the next sheet P. A length of the float airflow stop period is set depending on a size of sheets P (a length of each sheet P in the conveyance direction) and a sheet interval which is an interval of sheets P sequentially conveyed. A length of each conveyance cycle of sheets P depends on the length of the float airflow stop period.

During the sheet feed operation described above, the controller 13 performs the following control of the sheet feed tray 2 described above. The following control is described with reference to the flowchart of FIG. 11. The processing of the flowchart of FIG. 11 is started by the start of the sheet feed operation.

Figure 11:
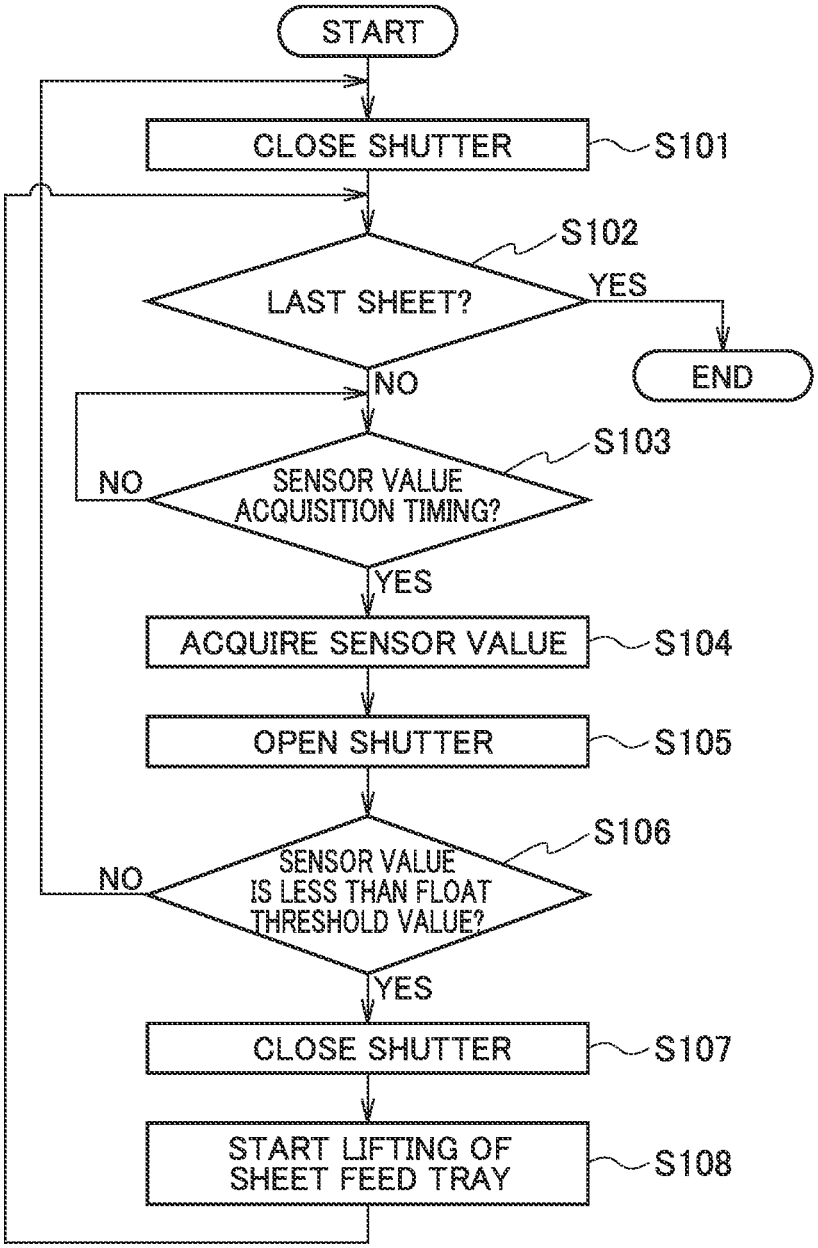
FIG. 11 is a flowchart illustrating a following control according to the second embodiment.

In step S101 of FIG. 11, the controller 13 closes the shutters 27, 32 at a start timing of the float airflow stop period.

Next, in step S102, the controller 13 determines whether a sheet P conveyed by the conveyor 11 in the float airflow stop period of this time is the last sheet P to be fed in the sheet feed operation of this time.

When the controller 13 determines that the sheet P conveyed by the conveyor 11 in the float airflow stop period of this time is not the last sheet P (step S102: NO), in step S103, the controller 13 determines whether the sensor value acquisition timing SVT illustrated in FIG. 10 comes. When the controller 13 determines that the sensor value acquisition timing SVT does not come (step S103: NO), the controller 13 repeats step S103.

The sensor value acquisition timing SVT is set as a timing at which sheets P floated by the floating unit 9 other than the top sheet P conveyed by the conveyor 11 are falling in the float airflow stop period.

The falling of sheets P starts little after a timing of closing the shutters 27, 32 (the start timing of the float airflow stop period). The sensor value acquisition timing SVT is set to be after start of the falling of sheets P. The sensor value acquisition timing SVT is set beforehand based on experiment and the like.

The timing at which sheets P start to fall varies depending on sheet types such as a thick sheet and a thin sheet and sheet sizes. Hence, the sensor value acquisition timing SVT is set to be a timing depending on combinations of the sheet types and the sheet sizes.

When the controller 13 determines that the sensor value acquisition timing SVT comes (step S103: YES), in step S104, the controller 13 acquires the sensor value from the upper limit sensor 12 at the sensor value acquisition timing SVT.

Note that the sensor value (each sensor value) during floating of sheets P is an amount of received light of a reflected light from the edge surfaces of sheets P in a state of being floated within the field of view (the detection range K) of the upper limit sensor 12. Hence, the sensor value during floating of sheets P becomes greater as the number of sheets P in a state of being floated within the field of view of the upper limit sensor 12 becomes greater.

The number of sheets P which are capable of being floated due to air blowing by the floating unit 9 is the number of sheets P existed within the float region F. Hence, the number of sheets P floated due to air blowing by the floating unit 9 becomes less as a height position of the top sheet P (the upper surface of the sheet stack PT) on the sheet feed tray 2 with sheets P on the sheet feed tray 2 not being floated becomes lower.

For this reason, the sensor value (each sensor value) during floating of sheets P can be artificially used as an upper surface position information indicating the height position of the top sheet P (the upper surface of the sheet stack PT) on the sheet feed tray 2 for the case where sheets P on the sheet feed tray 2 are not floated. If the height position of the sheet feed tray 2 is not changed, the number of floated sheets P becomes less as sheet feeding is progressed and thus the sensor values are on the decline.

Thus, in step S104 described above, the sheet feed device 1 acquires the sensor value used as the upper surface position information.

The reason why the sensor value acquisition timing SVT is set as the timing at which sheets P are falling is that there is less influence from noise in the sensor value due to floating unevenness of sheets P during the falling of sheets P.

In the sheet feed device 1, the floating state of sheets P changes with regularity in accordance with opening and closing operations of the shutters 27, 32. In accordance with the changes, the sensor value of the upper limit sensor 12 also changes with regularity.

However, the floating unevenness of sheets P such as floating of plural sheets P together (in one piece) and the like may be generated due to worsening of the sheet alignment on the sheet feed tray 2 caused by air blow to sheets P on the sheet feed tray 2 to flow sheets P, for example. The number of sheets P existing within the field of view of the upper limit sensor 12 may be temporarily increased, for example, due to the floating unevenness of sheets P and thus noise as illustrated in FIG. 10 may be generated in the sensor value. Acquisition of the sensor value with noise may decrease the accuracy of the following control.

Meanwhile, the behavior of floated sheets P is stable during the falling of sheets P and thus noise in the sensor value tends not to be generated. For this reason, the sensor value acquisition timing SVT is set as the timing at which sheets P are falling.

In step S105 of FIG. 11, the controller 13 opens the shutters 27, 32 at an end timing of the float airflow stop period.

Next, in step S106, the controller 13 determines whether the sensor value acquired in step S104 is less than a prescribed float threshold value. The float threshold value is set beforehand as a threshold value of the sensor value at the sensor value acquisition timing SVT for determining whether to lift the sheet feed tray 2. The float threshold value is set beforehand based on experiment and the like depending on the sheet types. Alternatively, the following threshold value determined in the first embodiment can be used as the float threshold value.

When determining that the sensor value is not less than the float threshold value (step S106: NO), the controller 13 returns to step S101 and closes the shutters 27, 32 at the start timing of the next float airflow stop period.

When determining that the sensor value is less than the float threshold value (step S106: YES), in step S107, the controller 13 closes the shutters 27, 32 at the start timing of the float airflow stop period next to the float airflow stop period in which the sensor value is acquired in step S104.

Next, in step S108, the controller 13 controls the lifting/lowering motor 3 to start lifting the sheet feed tray 2.

Specifically, the controller 13 starts the lifting of the sheet feed tray 2 by drive of the lifting/lowering motor 3 in the float airflow stop period next to the float airflow stop period in which the sensor value is acquired in step S104. The lifting of the sheet feed tray 2 may be started at the same time as the closing of the shutters 27, 32 in step S107.

Then, the controller 13 drives the lifting/lowering motor 3 to lift the sheet feed tray 2 for a prescribed drive period. When driving the lifting/lowering motor 3, the controller 13 controls the drive voltage of the lifting/lowering motor 3 depending on the difference between the sensor value acquired in step S104 and the float threshold value.

Specifically, the controller 13 controls to increase the drive voltage of the lifting/lowering motor 3 to increase a lift amount of the sheet feed tray 2 as the difference between the sensor value and the float threshold value is greater. As the difference between the sensor value and the float threshold value is greater, the number of sheets P within the float region F is less and the height position of the top sheet P (the upper surface of the sheet stack PT) on the sheet feed tray 2 for the case where sheets P on the sheet feed tray 2 are not floated are lower. Hence, the controller 13 controls to increase the lift amount of the sheet feed tray 2 as the difference between the sensor value and the float threshold value is greater. The relation between the difference between the sensor value and the float threshold value and the drive voltage of the lifting/lowering motor 3 is set beforehand based on experiment and the like depending on the sheet types.

After step S108, the controller 13 returns to step S102.

Note that a timing when the drive of the lifting/lowering motor 3 is terminated and the lifting of the sheet feed tray 2 is stopped may be after the sensor value acquisition timing SVT in the float airflow stop period at which the lifting of the sheet feed tray 2 is started in step S108.

Moreover, the drive of the lifting/lowering motor 3 may be controlled so as to complete the lifting of the sheet feed tray 2 within the float airflow stop period.

When the controller 13 determines that the sheet P is the last sheet P (step S102: YES), the controller 13 terminates the following control.

By the following control described above, the height position of the top sheet P (the upper surface of the sheet stack PT) on the sheet feed tray 2 with sheets P on the sheet feed tray 2 not being floated is maintained at the upper limit position which is the position suitable for sheet feeding.

As described above, in the sheet feed device 1, the controller 13 acquires the sensor value of the upper limit sensor 12 used for the following control at the sensor value acquisition timing SVT set as the timing at which sheets P floated by the floating unit 9 other than the top sheet P conveyed by the conveyor 11 are falling in the float airflow stop period. Thus, there is less influence from noise in the sensor value due to floating unevenness of sheets P and the accuracy of the following control can be therefore improved. Accordingly, problems in sheet feeding such as multiple feeding occurred due to too many floated sheets P, no sheet feeding occurred due to too few floated sheets P, and the like can be decreased or suppressed.

Moreover, the controller 13 controls the lifting/lowering motor 3 to start lifting the sheet feed tray 2 in the float airflow stop period when lifting the sheet feed tray 2 in the following control.

If the sheet feed tray 2 is lifted in a period when the shutters 27, 32 are opened, floated sheets P which newly enter into the float region F due to the lifting of the sheet feed tray 2 may affect the behavior of floated sheets P thereby generating floating unevenness of sheets P. This floating unevenness may generate noise in the sensor value and also affect the sensor value at the sensor value acquisition timing SVT. As a result, the accuracy of the following control may be decreased.

Meanwhile, a situation where the sheet feed tray 2 is lifted in the period when the shutters 27, 32 are opened can be avoided by starting lifting the sheet feed tray 2 in the float airflow stop period. Accordingly, generation of floating unevenness of sheets P due to the factors above can be prevented or suppressed and thus decrease in the accuracy of the following control can be suppressed.

Next, a third embodiment in which the following control of the second embodiment is modified is described.

In the third embodiment, the controller 13 performs a following control using moving average values as the upper surface position information. Each of the moving average values is an average value of the sensor values of the upper limit sensor 12 acquired in the latest float airflow stop periods of a prescribed moving average number of times described below.

Figure 12:
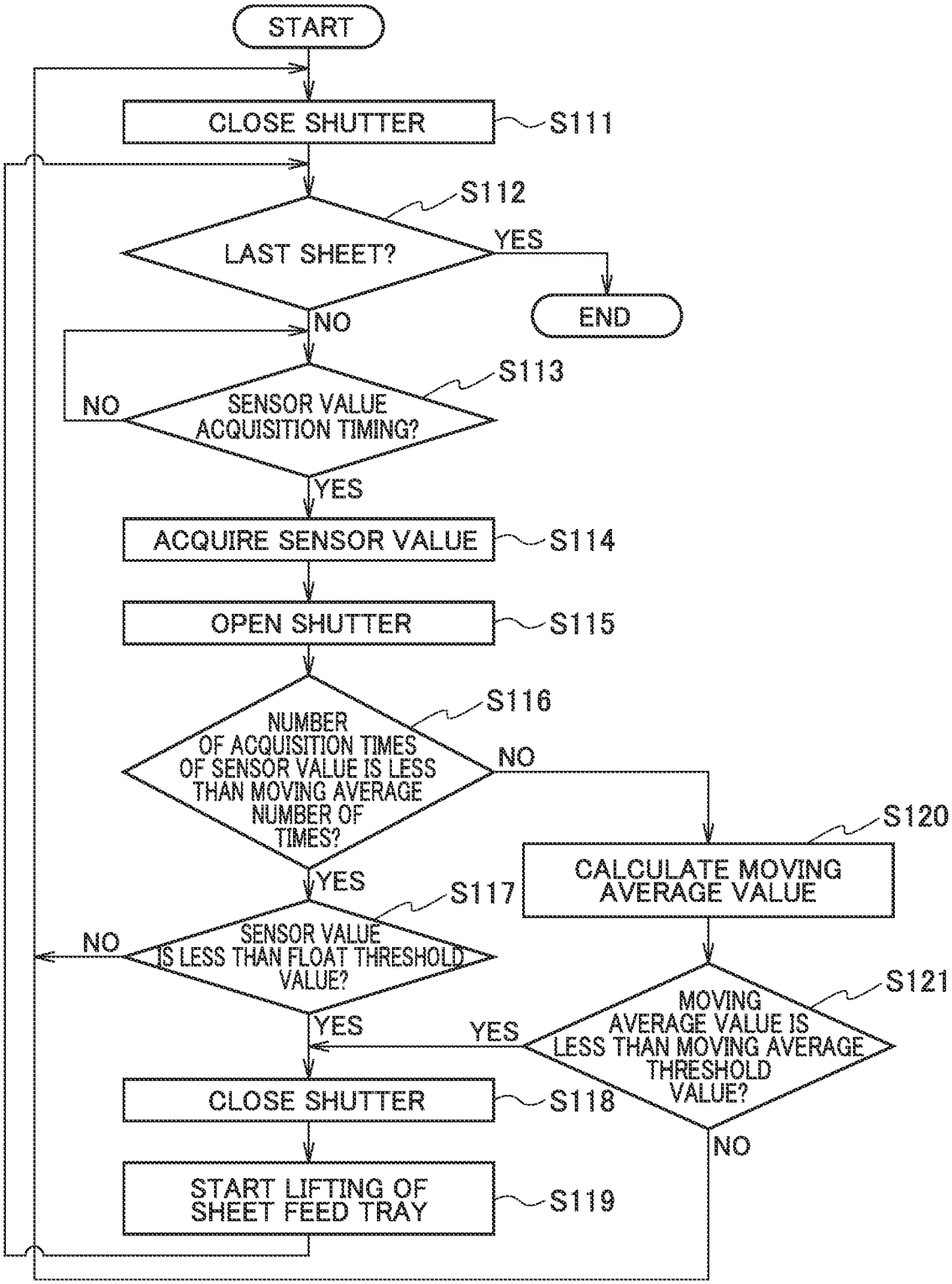
FIG. 12 is a flowchart illustrating a following control according to a third embodiment.

The following control according to the third embodiment is described with reference to the flowchart of FIG. 12. The processing of the flowchart of FIG. 12 is started by the start of the sheet feed operation. Note that the sheet feed operation of the third embodiment is the same as that of the second embodiment.

The processings of steps S111 to S115 of FIG. 12 are the same as the processings of steps S101 to S105 of FIG. 11 described above.

In step S116, the controller 13 determines whether a number of acquisition times of the sensor values from the start of the sheet feed operation of this time is less than the prescribed moving average number of times. In other words, the controller 13 determines whether the number of fed sheets P from the start of the sheet feed operation of this time until now is less than the moving average number of times. The moving average number of times is set beforehand as the number of acquisition times for the number of the sensor values for calculating the moving average values. The number of acquisition times is plural.

When determining that the number of acquisition times of the sensor values is less than the prescribed moving average number of times (step S116: YES), the controller 13 proceeds to step S117. The processings of steps S117 to S119 are the same as the processings of steps S106 to S108 of FIG. 11 described above.

When determining that the number of acquisition times of the sensor values is not less than the prescribed moving average number of times (step S116: NO), in step S120, the controller 13 calculates the moving average value which is the average value of the sensor values acquired in the latest float airflow stop periods of the moving average number of times including the float airflow stop period of this time.

Next, in step S121, the controller 13 determines whether the moving average value calculated in step S120 is less than a prescribed moving average threshold value. The moving average threshold value is set beforehand as a threshold value of the moving average values for determining whether to lift the sheet feed tray 2. The moving average threshold value is set beforehand based on experiment and the like depending on the sheet types.

When determining that the moving average value is less than the moving average threshold value (step S121: YES), the controller 13 proceeds to step S118.

When determining that the moving average value is not less than the moving average threshold value (step S121: NO), the controller 13 returns to step S111.

By the processing of the flowchart of FIG. 12 described above, the following control using the moving average values as the upper surface position information is performed after sheet feeding of sheets P of the moving average number of times. Before that timing, the moving average values cannot be calculated and thus the following control same as that of the second embodiment is performed.

Figure 13:
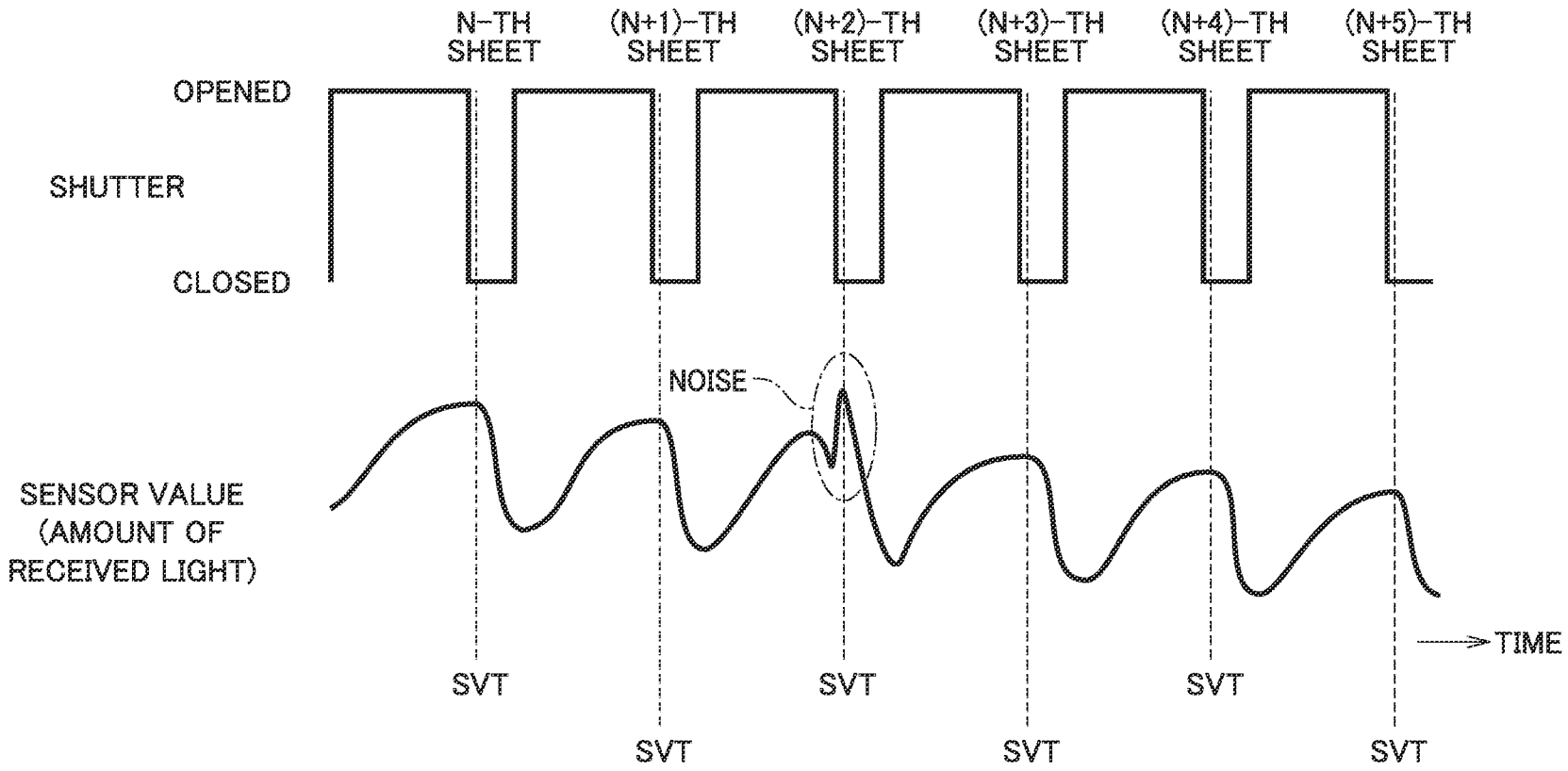
FIG. 13 is a diagram illustrating an example of a transition of sensor values.
Figure 14:
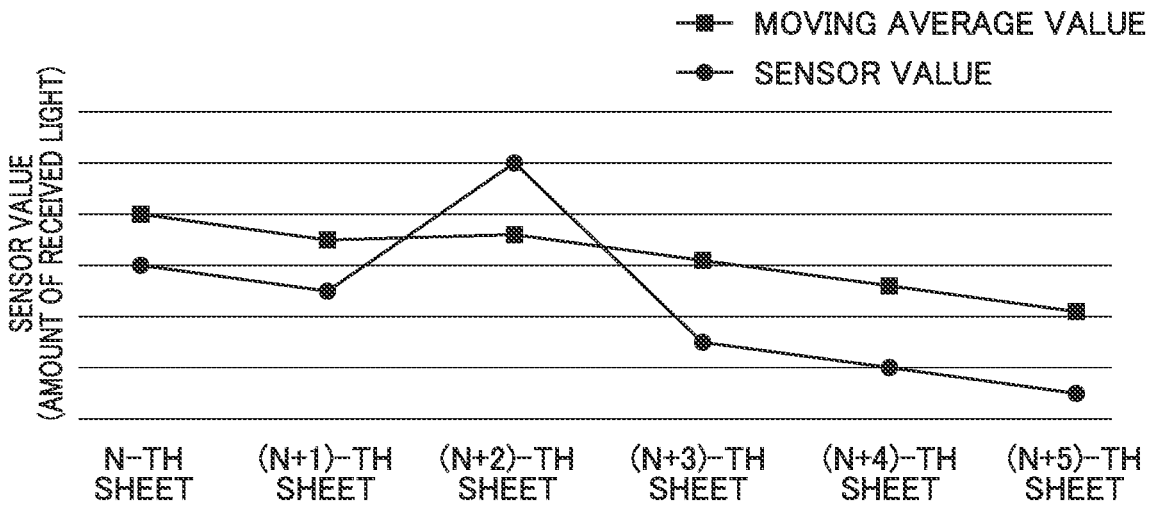
FIG. 14 is a diagram illustrating moving average values calculated from the sensor values of FIG. 13.

Even if noise is generated at the sensor value acquisition timing SVT as illustrated in FIG. 13, the influence of the noise is lessened in the moving average value as illustrated in FIG. 14. Note that the moving average value is 5 and n is an integer number greater than or equal to 5 in the examples of FIGS. 13 and 14. However, the moving average value is not limited to 5 and n is accordingly not limited to an integer number greater than or equal to 5.

As described above, in the third embodiment, after acquiring the sensor values of the moving average number of times, the controller 13, controls the lifting/lowering motor 3 based on the moving average value which is the average value of the sensor values acquired in the latest float airflow stop periods of the moving average number of times. Accordingly, even if noise is included in the acquired sensor values, the influence of the noise is lessened and thus decrease in the accuracy of the following control can be suppressed. Hence, problems in sheet feeding such as multiple feeding, no sheet feeding, and the like can be decreased or suppressed more.

Next, a fourth embodiment in which the following control of the second embodiment is modified is described.

In the fourth embodiment, the controller 13 performs a following control using cycle average values as the upper surface position information. Each of the cycle average values is an average value of the sensor values of the upper limit sensor 12 acquired at the sensor value acquisition timings SVT of a prescribed number of acquisition times described below in each conveyance cycle of sheets P.

Figure 15:
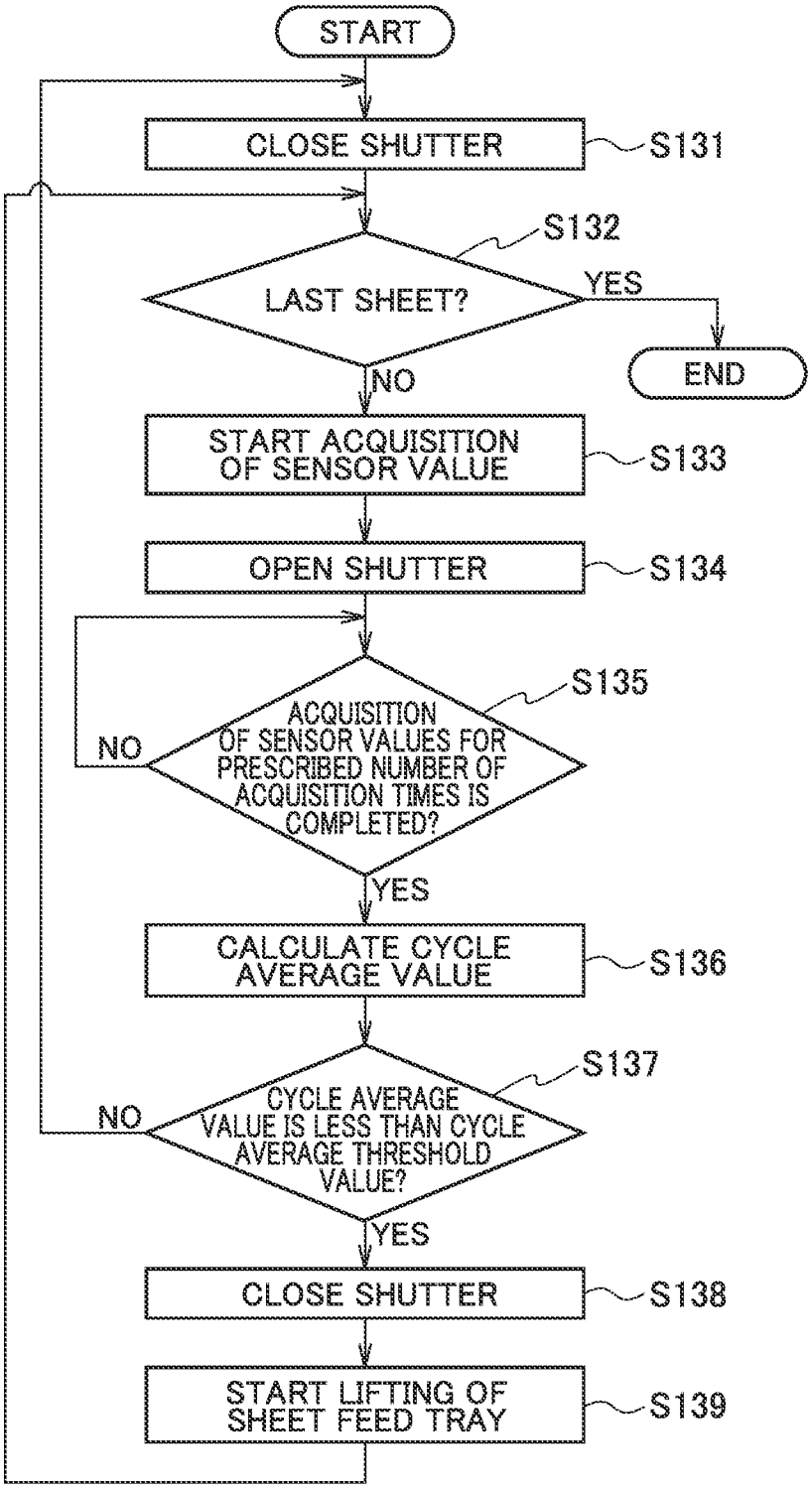
FIG. 15 is a flowchart illustrating a following control according to a fourth embodiment.

The following control according to the fourth embodiment is described with reference to the flowchart of FIG. 15. The processing of the flowchart of FIG. 15 is started by the start of the sheet feed operation. Note that the sheet feed operation of the fourth embodiment is the same as that of the second embodiment.

The processings of steps S131 and S132 of FIG. 15 are the same as the processings of steps S101 and S102 of FIG. 11 described above.

In step S133, the controller 13 starts acquiring the sensor values of the upper limit sensor 12. Specifically, the controller 13 acquires the sensor value at the first timing of the sensor value acquisition timings SVT set to be of the prescribed number of acquisition times in each conveyance cycle of sheets P.

Figure 16:
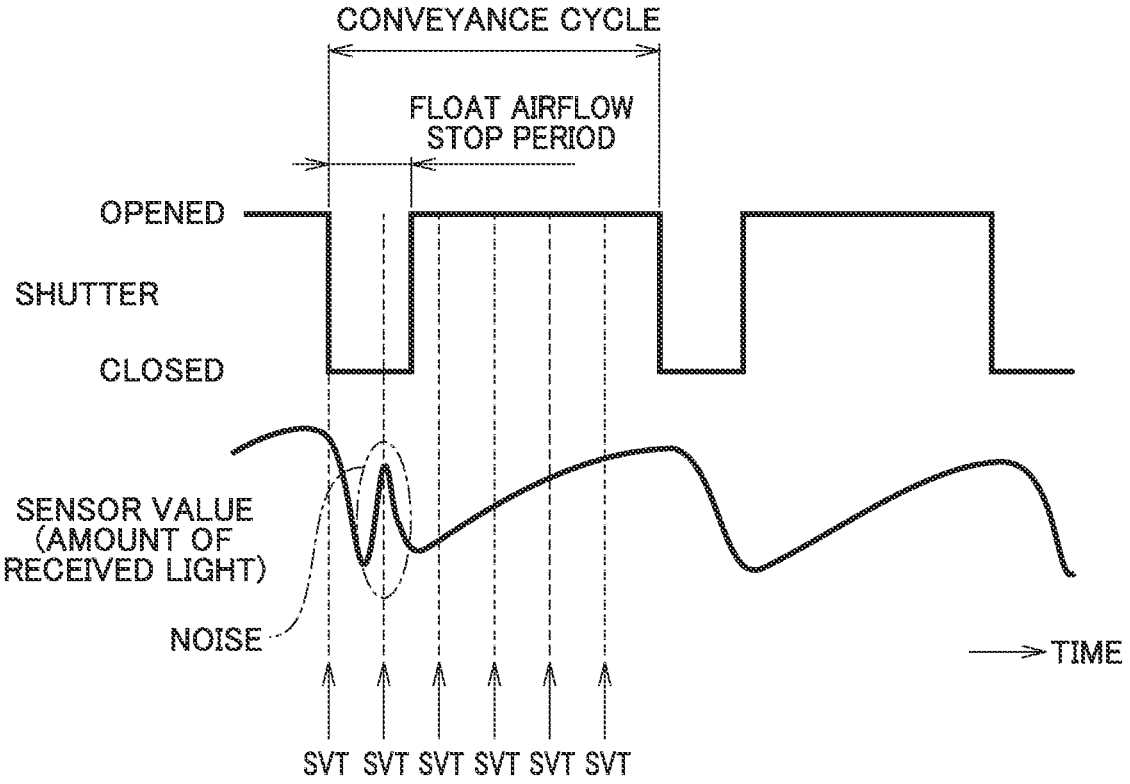
FIG. 16 is a diagram illustrating timings of acquiring sensor values according to the fourth embodiment.

Note that the prescribed number of acquisition times which is a plurality of times of acquiring the sensor values in each conveyance cycle of sheets P and the sensor value acquisition timings SVT of the prescribed number of acquisition times are set beforehand depending on the length of each conveyance cycle of sheets P. The sensor value acquisition timings SVT according to the fourth embodiment are set to be a plurality of timings with the equal intervals as illustrated in FIG. 16, for example. The first timing of the sensor value acquisition timings SVT in each conveyance cycle of sheets P may be the same timing as the closing of the shutters 27, 32.

After acquiring the sensor value at the first timing of the sensor value acquisition timings SVT, the controller 13 sequentially acquires the sensor values at the respective sensor value acquisition timings SVT of the prescribed number of acquisition times set beforehand.

After starting acquiring the sensor values of the upper limit sensor 12 in step S133, the controller 13 opens the shutters 27, 32 at the end timing of the float airflow stop period in step S134.

Next, in step S135, the controller 13 determines whether acquisition of the sensor values of the prescribed number of acquisition times is completed. When the controller 13 determines that acquisition of the sensor values of the prescribed number of acquisition times is not completed (step S135: NO), the controller 13 repeats step S135.

When the controller 13 determines that acquisition of the sensor values of the prescribed number of acquisition times is completed (step S135: YES), in step S136, the controller 13 calculates the cycle average value which is the average value of the sensor values of the prescribed number of acquisition times acquired in the conveyance cycle of sheets P of this time.

Next, in step S137, the controller 13 determines whether the cycle average value calculated in step S136 is less than a prescribed cycle average threshold value. The cycle average threshold value is set beforehand as a threshold value of the cycle average values for determining whether to lift the sheet feed tray 2. The cycle average threshold value is set beforehand based on experiment and the like depending on the sheet types.

When determining that the cycle average value is less than the cycle average threshold value (step S137: YES), the controller 13 proceeds to step S138. The processings of steps S138 and S139 are the same as the processings of steps S107 and S108 of FIG. 11 described above.

When determining that the cycle average value is not less than the cycle average threshold value (step S137: NO), the controller 13 returns to step S131.

By the processing of the flowchart of FIG. 15 described above, the following control using, as the upper surface position information, the cycle average values each of which is the average value of the sensor values of the prescribed number of acquisition times in each conveyance cycle of sheets P time is performed. By using the cycle average values as the upper surface position information, even if noise is generated in the sensor value as illustrated in FIG. 16, the influence of the noise to the upper surface position information is lessened.

Figure 17:
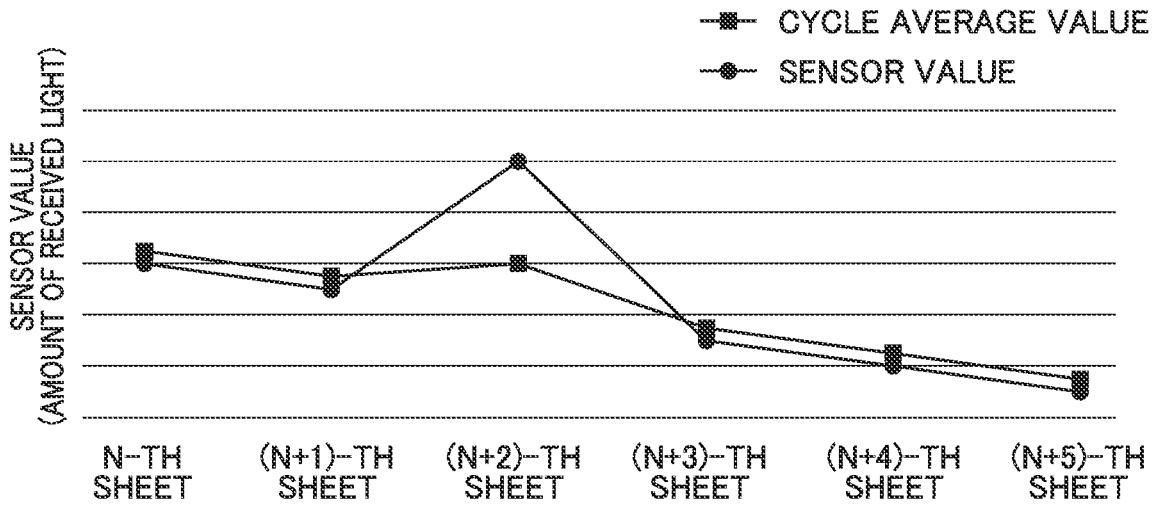
FIG. 17 is a diagram illustrating cycle average values calculated from the sensor values of FIG. 13.

When the sensor values exhibit the transition as illustrated in FIG. 13 described above, the cycle average values are the values illustrated in FIG. 17. The sensor values illustrated in FIG. 17 for comparison are the same as those illustrated in FIG. 14 and are values acquired from the sensor values illustrated in FIG. 13 at the sensor value acquisition timings SVT of the second and third embodiments. As illustrated in FIG. 17, the influence of the noise is lessened in the cycle average value.

As described above, in the fourth embodiment, the controller 13 controls the lifting/lowering motor 3 based on the cycle average values each of which is the average value of the sensor values acquired at the sensor value acquisition timings SVT of the prescribed number of acquisition times in each conveyance cycle of sheets P. Accordingly, even if noise is included in the acquired sensor values, the influence of the noise is lessened and thus decrease in the accuracy of the following control can be suppressed. Hence, problems in sheet feeding such as multiple feeding, no sheet feeding, and the like can be decreased or suppressed more.

Moreover, the sensor values of the past conveyance cycle of sheets P are not used in the fourth embodiment unlike the third embodiment and thus responsiveness is good.

Figure 18:
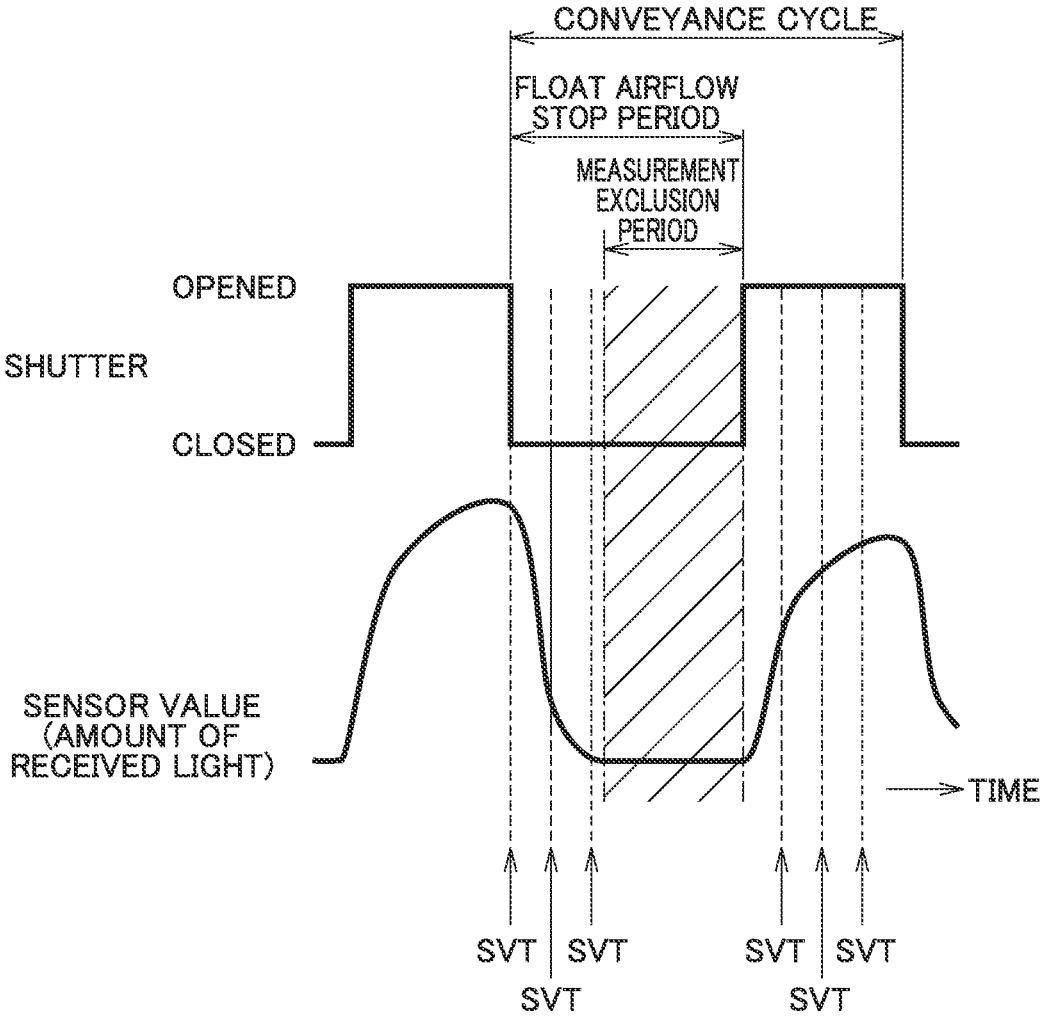
FIG. 18 is an explanatory view explaining a measurement exclusion period.

Note that, as illustrated in FIG. 18, a period from a timing a prescribed time after the start timing of the float airflow stop period to the end timing of the float airflow stop period may be set as a measurement exclusion period. Then, the sensor values of the prescribed number of acquisition times may be acquired in a period other than the measurement exclusion period in each conveyance cycle of sheets P.

In this case, a start timing of the measurement exclusion period is a timing at which all the sheets P floated by the floating unit 9 other than the top sheet P conveyed by the conveyor 11 fall below the lower limit of the field of view of the upper limit sensor 12. That is, the start timing of the measurement exclusion period is a timing at which changes in the sensor values due to the reflected light from sheets P are estimated to disappear due to the falling of sheets P. The time from the start timing of the float airflow stop period to the start timing of the measurement exclusion period is set beforehand based on experiment and the like depending on the sheet interval, the sheet types, and the sheet types of sheets P to be fed. Note that the measurement exclusion period may not exist according to conditions such as a case where the sheet interval of sheets P to be fed is short.

In the measurement exclusion period, no floated sheets P within the field of view of the upper limit sensor 12 exist and thus the sensor values stay small with almost no change. Each of the cycle average values is small if the sensor values in such a period are acquired. Hence, the degree of change in the cycle average values may become small and the accuracy of judging the magnitude relation between the cycle average values and the cycle average threshold value may be decreased. As a result, the accuracy of the following control may be decreased.

Meanwhile, provision of the measurement exclusion periods suppresses lowering of the cycle average values and thus suppresses decrease in the accuracy of the following control.

Figure 19:
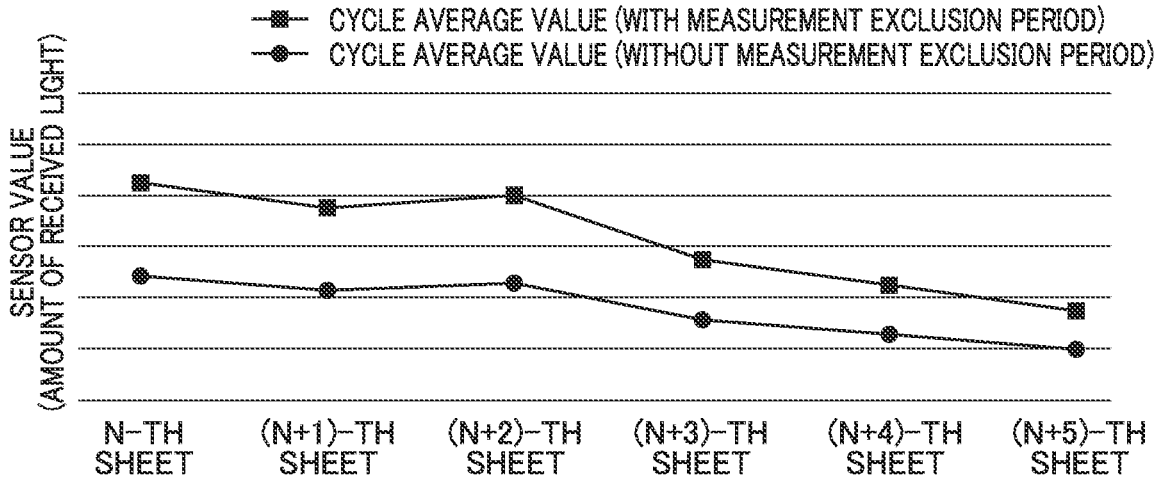
FIG. 19 is a diagram illustrating examples of cycle average values with and without the measurement exclusion periods.

FIG. 19 illustrate examples of the cycle average values with and without the measurement exclusion periods. As illustrated in FIG. 19, the case with the measurement exclusion periods can suppress lowering of the cycle average values more than the case without the measurement exclusion periods.

Note that, if the upper limit sensor 12 is arranged at a position where sheets P on the sheet feed tray 2 are within the field of view of the upper limit sensor 12 in a state where all the sheets P floated by the floating unit 9 other than the top sheet P conveyed by the conveyor 11 has fallen on the sheet feed tray 2, the start timing of the measurement exclusion period may be set to be a timing at which all the sheets P floated by the floating unit 9 other than the top sheet P conveyed by the conveyor 11 are estimated to fall on the sheet feed tray 2.

In the third embodiment, the sensor value acquisition timing SVT is the timing at which sheets P floated by the floating unit 9 other than the top sheet P conveyed by the conveyor 11 are falling as same as the second embodiment but the sensor value acquisition timing SVT is not limited to this configuration. Even if the sensor value acquisition timing SVT is a timing other than the aforementioned timing, the influence of the noise in the sensor values is lessened and thus decrease in the accuracy of the following control is suppressed by using, as the upper surface position information, the moving average values each of which is the average value of the sensor values acquired in a plurality of the latest float airflow stop periods.

Although the lifting of the sheet feed tray 2 is started in the float airflow stop period in the following control in the second to fourth embodiments, the lifting of the sheet feed tray 2 may be started in the period when the shutters 27, 32 are opened.

Also in this case, in the second embodiment, the sensor value is acquired at the sensor value acquisition timing SVT at which sheets P floated by the floating unit 9 other than the top sheet P conveyed by the conveyor 11 are falling in the float airflow stop period. Accordingly, there is less influence from the noise in the sensor values due to floating unevenness of sheets P and thus decrease in the accuracy of the following control can be therefore suppressed. Moreover, in the third embodiment, the moving average values are used as the upper surface position information. Accordingly, the influence of the noise in the sensor values is lessened and thus decrease in the accuracy of the following control is suppressed. Moreover, in the fourth embodiment, the cycle average values are used as the upper surface position information. Accordingly, the influence of the noise in the sensor values is lessened and thus decrease in the accuracy of the following control is suppressed.

Although the sheet feed device which feeds sheets such as paper is described in the embodiments above, the disclosure can be also applied to a device which feeds sheet-like material other than paper.

The embodiment of the disclosure has, for example, the following configuration.

A sheet feed device in accordance with some embodiments includes: a stacking tray on which a sheet stack is stacked and which is capable of being lifted and lowered; a floating unit configured to blow air to the sheet stack to float sheets of the sheet stack; a conveyor configured to convey a top sheet of the sheets floated by the floating unit to a supply destination; a detector configured to emit light from a side of the sheet stack toward the sheet stack and receive light reflected from the sheet stack; and a controller configured to drive the floating unit and the conveyor to perform a sheet feed operation, the controller being configured to, during the sheet feed operation, acquire an amount of received light at the detector during floating of sheets floated by the floating unit each time each sheet is conveyed by the conveyor and perform a following control of lifting the stacking tray upon the acquired amount of received light being less than a threshold value. The controller is configured to: after start of the sheet feed operation, sample amounts of received light at the detector during floating of the sheets floated by the floating unit; perform a threshold value determination process of determining the threshold value by using the sampled amounts of received light; and start the following control upon determining the threshold value.

The controller may: set a height position of the stacking tray at the start of the sheet feed operation such that a height position of an upper surface of the sheet stack is higher than a target position during the sheet feed operation; after the start of the sheet feed operation, in the threshold value determination process, sample an amount of received light at the detector during floating of the sheets floated by the floating unit with the height position of the stacking tray being fixed, at conveyance of each of sheets to be conveyed in a sampling period in which the height position of the upper surface of the sheet stack is lowered over the target position and; and determine the threshold value based on the sampled amounts of received light.

The controller may start the sampling period after conveyance of at least one sheet from the start of the sheet feed operation.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; in each of the stop periods, acquire an amount of received light at the detector at a timing at which the sheets floated by the floating unit other than a sheet conveyed by the conveyor are falling; and control the driver based on the acquired amounts of received light.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; acquire amounts of received light at the detector in the stop periods; and control the driver based on an average value of the amounts of received light acquired in a plurality of the latest stop periods.

The controller may acquire an amount of received light at the detector at a timing at which the sheets floated by the floating unit other than a sheet conveyed by the conveyor are falling.

In the sheet feed device in accordance with some embodiments above, the sheet feed device may further includes a driver configured to lift and lower the stacking tray. The detector may include a light emitter configured to emit light from the side of the sheet stack toward the sheet stack and a light receiver configured to receive light reflected from the sheet stack. In the following control, the controller may: control the floating unit to stop blowing air in a stop period in each conveyance cycle of sheets conveyed by the conveyor; and control the driver based on an average value of amounts of received light at a plurality of timings in each conveyance cycle.

The controller may acquire amounts of received light at a plurality of timings in each conveyance cycle in a period other than a period from a timing a prescribed time after a start timing of the stop period to an end timing of the stop period and calculate the average value.

The controller may control the driver to start lifting the stacking tray in the stop periods when lifting the stacking tray.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet feed device comprising:

a stacking tray on which a sheet stack is stacked and which is capable of being lifted and lowered;

a floating unit configured to blow air to the sheet stack to float sheets of the sheet stack;

a conveyor configured to convey a top sheet of the sheets floated by the floating unit to a supply destination;

a detector configured to emit light from a side of the sheet stack toward the sheet stack and receive light reflected from the sheet stack; and a controller configured to drive the floating unit and the conveyor to perform a sheet feed operation, the controller being configured to, during the sheet feed operation, acquire an amount of received light at the detector during floating of sheets floated by the floating unit each time each sheet is conveyed by the conveyor and perform a following control of lifting the stacking tray upon the acquired amount of received light being less than a threshold value, wherein the controller is configured to:

after start of the sheet feed operation, sample amounts of received light at the detector during floating of the sheets floated by the floating unit;

perform a threshold value determination process of determining the threshold value by using the sampled amounts of received light; and start the following control upon determining the threshold value.

2. The sheet feed device according to claim 1, wherein the controller is configured to:

set a height position of the stacking tray at the start of the sheet feed operation such that a height position of an upper surface of the sheet stack is higher than a target position during the sheet feed operation;

after the start of the sheet feed operation, in the threshold value determination process, sample an amount of received light at the detector during floating of the sheets floated by the floating unit with the height position of the stacking tray being fixed, at conveyance of each of sheets to be conveyed in a sampling period in which the height position of the upper surface of the sheet stack is lowered over the target position and; and determine the threshold value based on the sampled amounts of received light.

3. The sheet feed device according to claim 2, wherein the controller is configured to start the sampling period after conveyance of at least one sheet from the start of the sheet feed operation.

4. The sheet feed device according to claim 1, further comprising a driver configured to lift and lower the stacking tray, wherein the detector comprises a light emitter configured to emit light from the side of the sheet stack toward the sheet stack and a light receiver configured to receive light reflected from the sheet stack, and in the following control, the controller is configured to:

control the floating unit to stop blowing air in a stop period in each conveyance cycle of sheets conveyed by the conveyor;

in each of the stop periods, acquire an amount of received light at the detector at a timing at which the sheets floated by the floating unit other than a sheet conveyed by the conveyor are falling; and control the driver based on the acquired amounts of received light.

5. The sheet feed device according to claim 4, wherein the controller is configured to control the driver to start lifting the stacking tray in the stop periods when lifting the stacking tray.

6. The sheet feed device according to claim 1, further comprising a driver configured to lift and lower the stacking tray, wherein the detector comprises a light emitter configured to emit light from the side of the sheet stack toward the sheet stack and a light receiver configured to receive light reflected from the sheet stack, and in the following control, the controller is configured to:

control the floating unit to stop blowing air in a stop period in each conveyance cycle of sheets conveyed by the conveyor;

acquire amounts of received light at the detector in the stop periods; and control the driver based on an average value of the amounts of received light acquired in a plurality of the latest stop periods.

7. The sheet feed device according to claim 6, wherein, in each of the stop periods, the controller is configured to acquire an amount of received light at the detector at a timing at which the sheets floated by the floating unit other than a sheet conveyed by the conveyor are falling.

8. The sheet feed device according to claim 6, wherein the controller is configured to control the driver to start lifting the stacking tray in the stop periods when lifting the stacking tray.

9. The sheet feed device according to claim 1, further comprising a driver configured to lift and lower the stacking tray, wherein the detector comprises a light emitter configured to emit light from the side of the sheet stack toward the sheet stack and a light receiver configured to receive light reflected from the sheet stack, and in the following control, the controller is configured to:

control the floating unit to stop blowing air in a stop period in each conveyance cycle of sheets conveyed by the conveyor; and control the driver based on an average value of amounts of received light at a plurality of timings in each conveyance cycle.

10. The sheet feed device according to claim 9, wherein the controller is configured to acquire amounts of received light at a plurality of timings in each conveyance cycle in a period other than a period from a timing a prescribed time after a start timing of the stop period to an end timing of the stop period and calculate the average value.

11. The sheet feed device according to claim 9, wherein the controller is configured to control the driver to start lifting the stacking tray in the stop periods when lifting the stacking tray.

* * * * *